US006915088B2

(12) United States Patent
Nakagawa et al.

(10) Patent No.: US 6,915,088 B2
(45) Date of Patent: Jul. 5, 2005

(54) IMAGE FORMING APPARATUS

(75) Inventors: Ken Nakagawa, Mishima (JP); Koichi Otaka, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/414,230

(22) Filed: Apr. 16, 2003

(65) Prior Publication Data

US 2003/0228166 A1 Dec. 11, 2003

(30) Foreign Application Priority Data

Apr. 17, 2002 (JP) ..... 2002-114428

(51) Int. Cl.[7] ..... G03G 15/16
(52) U.S. Cl. ..... 399/66; 399/314
(58) Field of Search ..... 399/43, 45, 66, 399/85, 313, 314, 397

(56) References Cited

U.S. PATENT DOCUMENTS

| | | | | |
|---|---|---|---|---|
| 5,809,379 A | | 9/1998 | Yano et al. | 399/159 |
| 6,128,456 A | | 10/2000 | Chigono et al. | 399/176 |
| 6,334,032 B1 | | 12/2001 | Tomiki | 399/66 |
| 6,526,251 B1 | | 2/2003 | Otsuka et al. | 399/313 |
| 6,654,570 B2 | * | 11/2003 | Kato | 399/66 |
| 2001/0046389 A1 | | 11/2001 | Kuribayashi et al. | 399/45 |
| 2003/0016958 A1 | | 1/2003 | Wada et al. | 399/45 |

FOREIGN PATENT DOCUMENTS

| | | |
|---|---|---|
| JP | 06-003921 | 1/1994 |
| JP | 10-307455 | 11/1998 |
| JP | 11-352800 | 12/1999 |
| JP | 2000-172089 | 6/2000 |
| JP | 2000-330400 | 11/2000 |

* cited by examiner

*Primary Examiner*—Hoang Ngo
(74) *Attorney, Agent, or Firm*—Fitzpatrick, Cella, Harper & Scinto

(57) ABSTRACT

An image forming apparatus including a movable image bearing member, a charging member disposed opposed to the image bearing member, a transfer member for transferring a toner image from the image bearing member onto a recording material, and potential control means far changing a potential gradient on the image bearing member at a position corresponding to an end of the recording material in a direction opposite from a charge polarity of the toner with respect to a direction opposite from a movement direction of the image bearing member.

20 Claims, 13 Drawing Sheets

COMPARATIVE EMBODIMENT 1

EMBODIMENT 2

COMPARATIVE EMBODIMENT 3

EMBODIMENT 3

EMBODIMENT 4

COMPARATIVE EMBODIMENT 4

COMPARATIVE EMBODIMENT 5

EMBODIMENT 5

IMAGE FORMING APPARATUS

FIELD OF THE INVENTION AND RELATED ART

The present invention relates to an image forming apparatus having one or plural image forming sections in accordance with electrophotography, such as a monochromatic printer, a color printer, a facsimile apparatus or a copying machine.

(1) Cleaner-Less Image Forming Apparatus

In a conventional electrophotographic image forming apparatus, a transfer residual developer remaining on a recording material (image bearing member) after a developer image on the photosensitive member is transferred onto recording paper (recording medium) is removed from the photosensitive member surface by a cleaner (cleaning apparatus) to be recovered in a cleaner vessel which is separately provided. The thus recovered waste developer is discarded at the time of replacing a process cartridge including the cleaner vessel. However, from the viewpoints of the effective utilization of resources and environmental protection, it is desirable that no waste developer is generated.

In view of these viewpoints, an image forming apparatus of a developer recycling process wherein the cleaner is not used but the apparatus is designed to effect a "cleaning simultaneous with developing" such that the transfer residual developer remaining on the photosensitive member after the transfer operation is removed from the photosensitive member surface by a developing apparatus and recovered in the developing apparatus to be reused has been proposed.

More specifically, the concurrent developing and cleaning process is such a process that, at the time of development in a subsequent or later steps, i.e., at the time of developing a latent image after the latent image is formed again on a photosensitive drum already subjected to a previous development, and subsequent charging and exposure in a current cycle, the transfer residual developer remaining on the photosensitive member surface is recovered by applying a fog removal bias (a fog removal potential difference Vback as a potential difference between a DC voltage applied to the developing apparatus and a surface potential of the photosensitive member). According to this process, the transfer residual toner is recovered by the developing apparatus and reused in subsequent steps, so that waste developer is eliminated and with less maintenance requirement. Further, the cleaner-less system provides the advantage of space saving, thus allowing a considered size reduction of the resultant image forming apparatus.

(2) Charging

A corona type charger (corona discharging device) has been widely used as a charging apparatus for charging (inclusive of discharging) an image bearing member (object or member to be charged) such as an electrophotographic photosensitive member or an electrostatic dielectric recording member to a predetermined polarity and a predetermined potential level in an image forming apparatus.

The corona type charging device is a noncontact type charging device, and comprises a corona discharging electrode such as a wire electrode, and a shield electrode which surrounds the corona discharging electrode. It is disposed in a noncontact state so that the corona discharging opening thereof faces an image bearing member, that is, an object to be charged. In usage, the surface of an image bearing member is charged to a predetermined potential level by being exposed to discharge current (corona shower) generated as high voltage is applied between the corona discharging electrode and the shield electrode.

The corona type charging device is capable of effecting charging with an object to be charged in a noncontact state, so that when it is used in the above-mentioned cleaner-less type image forming apparatus, it is possible to alleviate such a problem that a transfer residual developer attaches to the charging device to lower its charging performance. However, the corona type charging device has been accompanied with essential problems, irrespective of presence or absence of the cleaner, such that active ions such as ozones are contained in the ozone shower to require a large power consumption and a large-sized apparatus.

For this reason, in an image forming apparatus of low to medium speed, many a contact type charging apparatus having advantages over a corona type charging apparatus in terms of low ozone production, low power consumption, or the like, have been proposed and have been put to practical use.

In order to charge an object such as an image bearing member with the use of a contact type charging apparatus, the electrically conductive charging member (contact type charging member, contact type charging device, or the like) of a contact type apparatus is placed in contact with the object to be charged, and an electrical bias (charge bias) of a predetermined level is applied to this contact type charging member so that the surface of the object to be charged is charged to a predetermined polarity and a predetermined potential level. The charging member is available in various forms, for example, a roller type (charge roller), a fur brush type, a magnetic brush type, a blade type, and the like.

In reality, when an object is electrically charged by a contact type charging member, two types of charging mechanisms (charging mechanism or charging principle: 1) mechanism which discharges electrical charge, and 2) mechanism for infecting charge) come into action. Thus, the characteristics of each of contact type charging apparatuses or methods are determined by the charging mechanism which is the dominant one of the two in charging the object.

1) Electrical Discharge Based Charging Mechanism

This charging mechanism is a charging mechanism in which the surface of an object to be charged is charged by electrical discharge which occurs across a microscopic gap between a contact type charging member and the object to be charged.

In the case of the electrical discharge based charging mechanism, there is a threshold voltage which must be surpassed by the charge bias applied to a contact type charging member before electrical discharge occurs between a contact type charging member and an object to be charged, and therefore, in order for an object to be charged through the electrical discharge based charging mechanism, it is necessary to apply to the contact type charging member a voltage with a value greater than the value of the potential level to which the object is to be charged. Thus, in principle when the electrical discharge based charging mechanism is in action, it is impossible to avoid generating by-produce of electrical discharge, that is, active ions such as ozone ions. In reality, even a contact type charging apparatus charges an object partially through the electrical charge discharging mechanism as described above, and therefore, a contact type charging apparatus cannot completely eliminate the problems caused by the active ions such as ionized ozone.

2) Direct Charge Injection Mechanism

This is a mechanism in which the surface of an object to be charged is charged as electrical charge is directly injected into the object to be charged, with the use of a contact type charging member. Thus, this mechanism is called "direct charging mechanism", or "charge injection mechanism". More specifically, a contact type charging member with medium electrical resistance is placed in contact with the surface of an object to be charged to directly inject electrical charge into the surface portion of an object to be charged, without relying on electrical discharge, in other words, without using electrical discharge in principle. Therefore, even if the value of the voltage applied to a contact type charging member is below the discharge starting voltage value, the object to be charged can be charged to a voltage level which is substantially the same as the level of the voltage applied to the contact type charging member.

This direct injection charging mechanism does not suffer from the problems caused by the by-product of electrical discharge since it is not accompanied by ozone production. However, in the case of this charging mechanism, the state of the contact between a contact type charging member and an object to be charged greatly affects the manner in which the object is charged, since this charging mechanism is such a mechanism that directly charges an object. Thus, this direct injection charging mechanism should comprise a contact type charging member composed of high density material, and also should be given a structure which provides a large speed difference between the charging member and the object to be charged, so that a given point on the surface of the object to be charged makes contact with a larger area of the charging member.

A) Charging Apparatus with Charge Roller

In the case of a contact type charging apparatus, a roller charge system, that is, a charging system which employs an electrically conductive roller (charge roller) as a contact type charging member, is widely used because of its desirability in terms of safety.

As for the charging mechanism in this roller charge system, the aforementioned (1) charging mechanism, which discharges electrical charge, is dominant.

Charge rollers are formed of rubber or foamed material with substantial electrical conductivity, or electrical resistance of a medium level. In some charge rollers, the rubber or foamed material is layered to obtain a specific characteristic.

In order to maintain a certain contact state between a charge roller and an object to be charged, a charge roller is given elasticity, which in turn increases frictional resistance between the charge roller and the object to be charged. Also in many cases, a charge roller is rotated by the rotation of a photosensitive member, or is individually driven at a speed slightly different from that of the photosensitive member.

B) Charging Apparatus with Fur Brush

In the case of this charging apparatus, a charging member (fur brush type charging device) with a brush portion composed of electrically conductive fiber is employed as the contact type charging member. The brush portion composed of electrically conductive fiber is placed in contact with a photosensitive member as an object to be charged, and a predetermined charge bias is applied to the charging member to charge the peripheral surface of the photosensitive member to a predetermined polarity and a predetermined potential level.

Also in the case of this charging apparatus with a fur brush, the dominant charging mechanism is the aforementioned 1 (electrical discharge based) charging mechanism.

It is known that there are two type of fur brush type charging devices: a fixed type and a roller type. In the case of the fixed type, fiber with medium electrical resistance is woven into foundation cloth to form pile, and a piece of this pile is adhered to an electrode. In the case of the rotatable type, the pile is wrapped around a metallic core. In terms of fiber density, pile with a density of 100 fiber/cm$^2$ can be relatively easily obtained.

Also in the case of the contact type charging apparatus which comprises a fur brush, whether the fur brush is of the fixed type or the roller type, the object to be charged is charged mainly through electrical discharge triggered by applying to the fur brush a charge bias the voltage level of which is higher several hundred volts than the potential level desired for the object to be charged.

In the case of using the fur brush type charging apparatus in the cleaner-less type image forming apparatus, it is possible to alleviate image failure caused by image history by the effect of scattering the transfer residual developer with the fur brush. Further, compared with other charging apparatus, the fur brush type charging apparatus has a buffer effect such that the transfer residual toner is caught by the fur brush which has a relatively larger surface area, thus being suitable for the cleaner-less type image forming apparatus.

C) Magnetic Brush Type Charging Apparatus

A charging apparatus of this type comprises a magnetic brush portion (magnetic brush based charging device) as the contact type charging member. A magnetic brush is constituted of electrically conductive magnetic particles magnetically confined in the form of a brush by a magnetic roller or the like. This magnetic brush portion is placed in contact with a photosensitive member as an object to be charged, and a predetermined charge bias is applied to the magnetic brush to charge the peripheral surface of the photosensitive member to a predetermined polarity and a predetermined potential level.

In the case of this magnetic brush type charging apparatus, the dominant charging mechanism is the charge injection mechanism 2).

As for the material for the magnetic brush portion, electrically conductive magnetic particles, the diameters of which are in a range of 5–50 $\mu$m, are used. With the provision of sufficient difference in peripheral velocity between a photosensitive drum and a magnetic brush, the photosensitive member can be uniformly charged through charge injection.

In the case of a magnetic brush type charging apparatus, the photosensitive member is charged to a potential level which is substantially equal to the voltage level of the bias applied to the contact type charging member.

Japanese Laid-Open Patent Application (JP-A) No. Hei 6-3921 discloses a contact injection charging method, according to which a photosensitive member is charged by injecting electric charge into the charge injectable surface layer thereof, more specifically, into the traps or electrically conductive particles in the charge injectable surface layer. Since this method does not rely on electrical discharge, the voltage level necessary to charge the photosensitive member to a predetermined potential level is substantially the same as the potential level to which the photosensitive member is to be charged, and in addition, no ozone is generated. Further, since AC voltage is not applied, there is no noise traceable to the application of AC voltage. In other words, a magnetic brush type charging system is an excellent charging system superior to the roller type charging system in terms of ozone generation and power consumption, since it does not generate ozone, and uses far less power compared to the roller type charging system. Further, in the case of using the magnetic brush type charging apparatus in the cleaner-less type image forming apparatus, similarly as in-the case of the fur brush type charging apparatus, the magnetic brush type charging apparatus also has the scattering effect and the buffer effect, thus being suitable for the cleaner-less type image forming apparatus.

However, the magnetic brush type charging apparatus also has its own problems. For example, it is complicated in structure. Also, the electrically conductive magnetic particles which constitute the magnetic brush portion become separated from the magnetic brush and adhere to the photosensitive member.

D) Power Coating Contact Charging

In order to effect stably effect stably uniform charging in a contact charging apparatus while preventing charge irregularity, a method wherein a contact surface of a contact charging member with a member to be charged is coated with powder has been proposed. For example, JP-A Hei 10-307455 discloses a contact charging method which utilizes a direct injection charging mechanism, and specifically uses a charge roller prepared by forming an electroconductive foam member at a peripheral surface of a core metal to provide a roller and then coating the roller peripheral surface with electroconductive particles. The use of a lot of electroconductive particles considerably increases opportunity to contact the member to be charged to realize direct injection charging. Further, this charging method employs the electroconductive foam member which functions as a buffer for holding the electroconductive particles an a transfer residual developer, thus being suitable for a cleaner-less type image forming apparatus.

Incidentally, in the cleaner-less system, dealing with the resultant transfer residual developer becomes a significant problem. In the cleaner-less system, the influence of the transfer residual developer on charging performance is alleviated by scattering or recovering the transfer residual developer with the charging means as described above. However, in the cleaner-less system, the developer is essentially present in the neighborhood of the charging means and the photosensitive member, so that the developer close to the charging means attaches to the photosensitive member depending on the surface potential of the photosensitive member before charging to cause image failure on a subsequent image in some cases. Particularly, a potential memory is formed on the photosensitive member when a leading (front) end or a trailing (rear) end of paper as a recording material passes through an abutting portion between a transfer roller and the photosensitive member or the neighborhood thereof and leads to an occurrence of image failure in terms of latent streak image in some cases.

SUMMARY OF THE INVENTION

An object of the present invention is to provide a image forming apparatus capable of preventing an occurrence of a streak-like image failure by a toner remaining in the neighborhood of a charging member.

According to the present invention, there is provided an image forming apparatus, comprising:

a movable image bearing member, a charging member disposed opposed to said image bearing member, a transfer member for transferring a toner image from said image bearing member onto a recording material, and potential control means for changing a potential gradient on said image bearing member at a position corresponding to an end of the recording material in a direction opposite from a charge polarity of the toner with respect to a direction opposite from a movement direction of said image bearing member.

According to the present invention, there is also provided an image forming apparatus, comprising:

a movable image bearing member, a charging member disposed opposed to said image bearing member, a transfer member for transferring a toner image from said image bearing member onto a recording material, a power supply for applying a voltage to said transfer member, and potential control means for changing a potential gradient on said image bearing member at a position corresponding to an end of the recording material in a direction opposite from a charge polarity of the toner with respect to a direction opposite from a movement direction of said image bearing member, wherein said transfer member and said image bearing member form a transfer nip having a width W, and with respect to a movement direction of the recording material, the following relationships are satisfied:

V2−V1>V3−V4 when the toner has a negative charge polarity, and

V2−V1<V3−V4 when the toner has a positive charge polarity, wherein V1 represents a voltage applied to said transfer member when a leading and of said recording material is located upstream from an upstream end of the transfer nip by W; V2 represents a voltage applied to said transfer member when the leading end of said recording material is located downstream from the upstream end of the transfer nip by W; V3 represents a voltage applied to said transfer member when a trailing end of said recording material is located upstream from a downstream end of the transfer nip by W; and V4 represents a voltage applied to said transfer member when the trailing end of said recording material is located downstream from the downstream end of the transfer nip by W.

According to the present invention, there is further provided an image forming apparatus, comprising:

a movable image bearing member, a charging member disposed opposed to said image bearing member, a transfer member for transferring a toner image from said image bearing member onto a recording material, a power supply for applying a voltage to said transfer member, and potential control means for changing a potential gradient on said image bearing member at a position corresponding to an end of the recording material in a direction opposite from a charge polarity of the toner with respect to a direction opposite from a movement direction of said image bearing member, wherein said transfer member and said image bearing member form a transfer nip having a width W, and with respect to a movement direction of the recording material, the following relationships are satisfied:

$$(V2-V1)/2W>(V4-V3)/2W>E3, \text{ and}$$

$$(V2-V1)/2W>|E3|,$$

wherein V1 represents a voltage applied to said transfer member when a leading and of said recording material is located upstream from an upstream end of the transfer nip by W; V2 represents a voltage applied to said transfer member when the leading end of said recording material is located downstream from the upstream end of the transfer nip by W; V3 represents a voltage applied to said transfer member when a trailing end of said recording material is located upstream from a downstream end of the transfer nip by W; V4 represents a voltage applied to said transfer member when the trailing end of said recording material is located downstream from the downstream end of the transfer nip by W; and E3 represents a maximum of the potential gradient having a polarity opposite from the charge polarity of the toner.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, preferred embodiments of the image forming apparatus according to the present invention will be described with reference to the drawings.

(1) General Construction of Image Forming Apparatus

Figure 1:
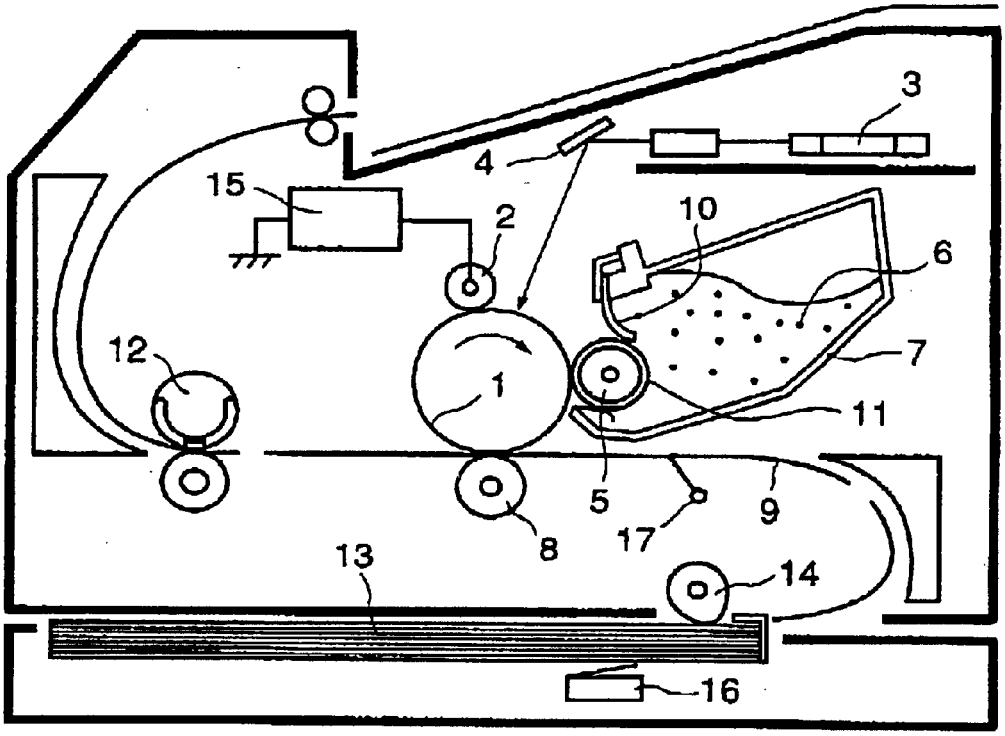
FIG. 1 is a schematic sectional view of an embodiment of the image forming apparatus according to the present invention.

FIG. 1 is a schematic sectional view of an image forming apparatus in this embodiment.

The image forming apparatus is an electrophotographic laser beam printer of a contact charging type and of a cleaner-less type.

Referring to FIG. 1, the image forming apparatus includes a rotating-drum type photosensitive member (drum) 1 as an image bearing member, charging apparatus (charging member) 2, a laser exposure apparatus 3, a reflection mirror 4, a magnet 5, a developer 6, a developer container 7, a transfer roller (transfer member) 8, a paper recording material (medium) or transfer material) 9, a developing blade 10, a developing sleeve 11, a fixing apparatus 12, a paper cassette 13, a paper-feeding roller 14, a high-voltage power supply 15, a paper detection sensor 16, and a paper leading end detection sensor 17. The photosensitive member 1 rotates in a direction of an arrow and is uniformly charged by the charging member 2 to a negative polarity in this embodiment. The photosensitive member 1 is then irradiate with a laser beam emitted from the laser exposure apparatus 3 and reflected by the reflection mirror 4, whereby an electrostatic latent image is formed on the photosensitive member surface.

In the developer container 7, the developer is filled, and after being subjected to appropriate charging in an appropriate amount by rotation of the developing sleeve 11 containing the magnet 5 therein, is supplied onto the photosensitive member surface. The developer carried on the developing sleeve 11 attaches to the electrostatic latent image formed on the photosensitive member surface to develop and visualize the latent image a a developer (toner) image. In this embodiment, the developer comprises a negatively chargeable toner and the latent image is developed in a reversal development manner. The recording medium 9 is supplied from the paper cassette 13 paper by paper at a timing given by the paper supply roller 14 and is carried to an abutting portion between the transfer roller 8 and the photosensitive member 1. At the abutting portion, the visualized developer image formed on the photosensitive member surface is electrostatically transferred onto the recording medium 9 by applying a voltage to the transfer roller 8.

A part of the transfer residual developer remaining on the photosensitive member surface attaches to the charging member 2 and another part of the transfer residual developer is charged by the charging member 2 to attach to the photosensitive member 1. As a result, a circulation phenomenon such that the developer is returned to the developing sleeve 11 at an opposing position between the photosensitive member 1 and the developing sleeve 11 is caused to occur further, the recording medium 9 carrying thereon the developer image is heated and pressed by the fixation apparatus 12, and the developer image is permanently fixed onto the recording medium 9.

(2) Cleaner-Less System

Figure 2:
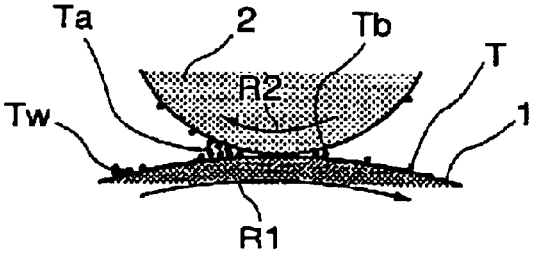
FIG. 2 is a schematic illustration of an abutting portion between a charging member and a photosensitive member in a cleaner-less system.

FIG. 2 schematically illustrates the abutting portion (charging portion) between the charging member (hereinafter, referred to as a "charging roller") 2 and the photosensitive member 1.

Referring to FIG. 2, the photosensitive member 1 rotates in a direction of an arrow R1. The charge roller 2 rotates in a direction of an arrow R2 with a difference in peripheral speed.

A transfer residual developer Tw reaches a developer accumulation Ta located upstream from the abutting portion between the charging roller 2 and the photosensitive member 1 by the rotation of the photosensitive member 1 and is accumulated at the developer accumulation portion Ta. Then, a part of the developer is scattered by the movement of the charging roller 2 and a part of the developer is gradually carried onto the charge roller 2 and, via a developer accumulation portion Tb, is discharged onto the photosensitive member 1 to constitute a developer T.

The developer accumulation portion Ta functions as a buffer for temporarily accumulating the transfer residual developer. Even if an amount of the carried transfer residual developer somewhat fluctuates, an amount of the transfer residual developer attaching the charge roller 2 is less changed and is gradually returned to the photosensitive member 1, followed by recovery thereof by the developing apparatus However, if a large (stepwise) potential difference is formed between the charge roller 2 and the photosensitive member 1, the above balanced state is broken and cannot be remedied by the scattering effect and the buffer effect.

Figure 3:
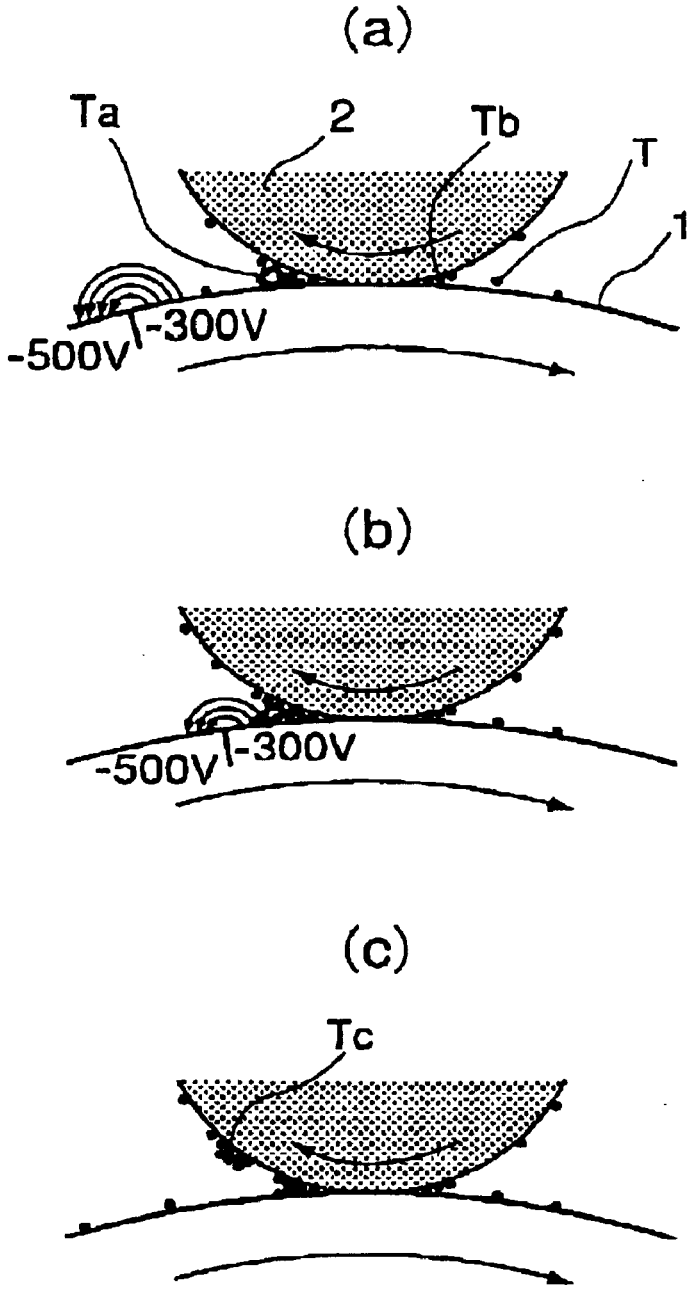
FIGS. 3(*a*) to 3(*c*) are views for illustrating a problem of the charging member in the cleaner-less system.

FIGS. 3(*a*) to 3(*c*) are views for illustrating a mechanism of an occurrence of image failure in this embodiment (cleaner-less type image forming apparatus) confirmed as a result of our extensive study.

Referring to FIG. 3(*a*), in a direction opposite from a movement direction of the photosensitive member 1, a stepwise potential difference having a negative potential gradient is formed. In the neighborhood of the potential difference portion, electric line of force is formed as shown in the figure. In this embodiment, a negatively chargeable developer is used, and the electric line of force of the potential difference acts in such a direction that the developer at the developer accumulation portion Ta is repelled.

FIG. 3(*b*) is a schematic illustration showing a state that the photosensitive member 1 is further moved from the state of FIG. 3(*a*). By the rotation of the photosensitive member 1, the developer at the developer accumulation portion Ta is repelled by the repulsive force (of electric line of force) to be forced into an abutting portion between the charge roller 2 and the photosensitive member 1.

FIG. 3(*c*) is a schematic illustration showing a state that the photosensitive member 1 is further moved from the state of FIG. 3(*b*). The developer forced into a wedge-shape space by the potential difference cannot be accumulated any longer, but a relatively large amount of a developer Tc attaches to the charge roller 2. By the rotation of the charge roller 2, the developer Tc goes around the charge roller 2 and a part of the developer Tc is again attached onto the surface of the photosensitive member 1, thus resulting in a streak of the developer formed on the photosensitive member 1 surface.

If the developer is subjected to a subsequent exposure step in such a state that a large amount of the streak-shaped developer is carried on the photosensitive member 1 at the same time, an optical path is blacked by the developer to impair image formation. Further, all the developer carried on the photosensitive member 1 cannot be recovered by cleaning performed with developing at the same time. As a result, the developer is visualized as a streak image failure on a subsequent recording medium.

Particularly, when a leading end (front end) or a trailing end (rear end) of paper as the recording medium passes through a transfer portion, a stepwise potential difference is liable to occur on the photosensitive member 1 in the following two points.

First, a charge amount imparted to the photosensitive member 1 by the transfer apparatus 8 is charged depending on whether the recording medium 9 is present or absent between the transfer apparatus 8 and the photosensitive member 1, thus generating a stepwise potential difference at the leading end or the trailing end of the recording medium 9.

Secondly, a minute discharge is caused to occur between the recording medium 9 and the photosensitive member 1 when the recording medium 9 is attached to or detached from the photosensitive member 1. Particularly, the end (edge) of the recording medium 9 has a sharp form, thus being liable to form discharge point due to electric field concentration thereat. For this reason, the potential difference due to discharge spike is liable to occur on the photosensitive member 1 through the discharge.

Figure 4:
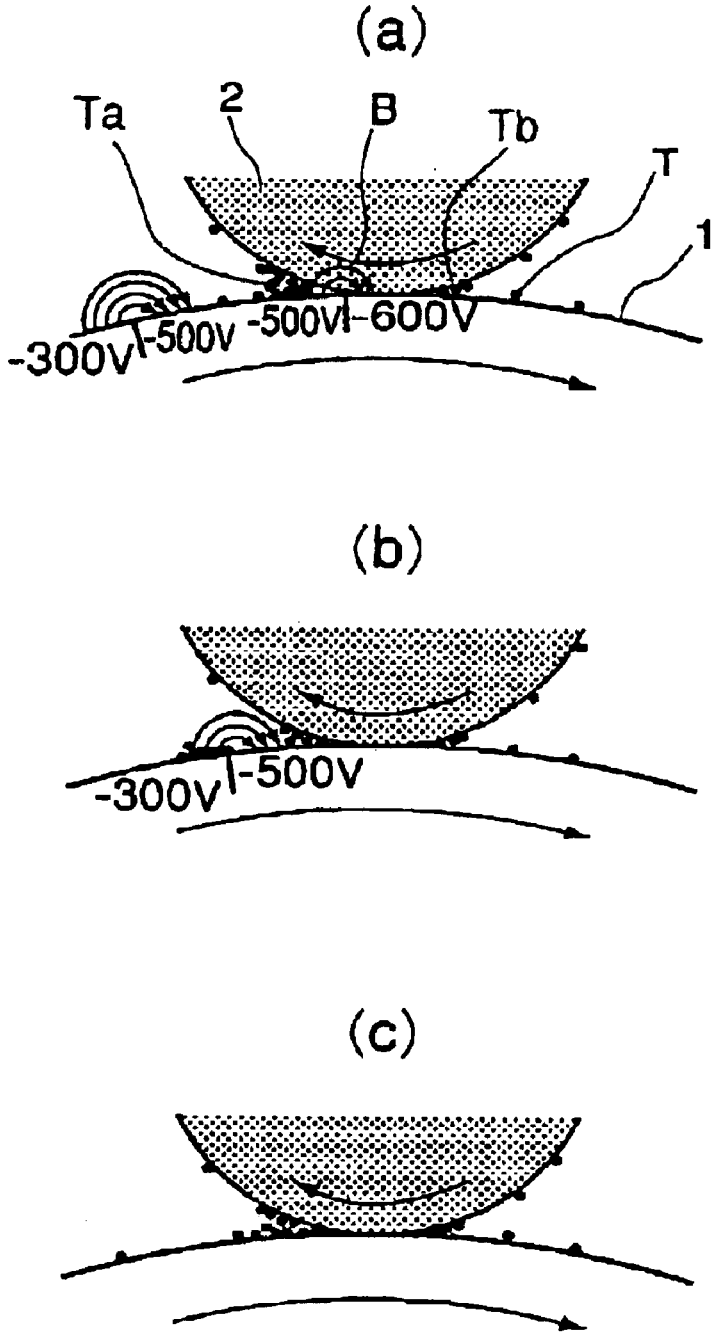
FIGS. 4(*a*) to 4(*c*) are views for illustrating an operation principle of the image forming apparatus of the present invention.

FIGS. 4(*a*) to 4(*c*) are views of a cleaner-less type image forming apparatus of the present invention for explaining a mechanism of suppressing an occurrence of the streak image failure, and more specifically are sectional views illustrating the neighborhood of an abutting portion between a photosensitive member 1 and a charge roller 2.

Referring to FIG. 4(*a*), a photosensitive member 1 as an image bearing member moves in a direction of a lower arrow. A charge roller 2 moves in a direction of an upper arrow so that it contacts and rubs the photosensitive member 1 in a direction counter to or opposite from the movement direction of the photosensitive member 1. The photosensitive member 1 is electrically charged by the charge roller 2 supplied with a voltage from a high-voltage power supply (not shown) and then is subjected to a subsequent step.

A developer accumulation portion Ta is located at a portion entering an abutting portion between the photosensitive member 1 and the charge roller 2 on an upstream side in the movement direction of the photosensitive member 1, and functions as a buffer for temporarily accumulating the transfer residual developer in the cleaner-less system. In the case where there is a speed difference between the charge roller 2 and the photosensitive member 1, the developer accumulation portion Ta is formed due to three factors including: a mechanical factor that the developer does not readily enter physically the abutting portion, thus leading to a mechanical barrier; a spatial factor that a wedge-like space where the developer is liable to accumulate by contact between curved surfaces of the charge roller 2 and the photosensitive member 1 is formed; and an electrical factor that on the surface of the photosensitive member 1, a stepwise potential difference is present at a portion before and after an acting (working) portion where the photosensitive member 1 is charged in the neighborhood of an opposing portion with the charge roller 2 and the potential difference provides a portion (indicated as B in FIG. 3(*a*)) acting as an electrical barrier (considered to be equivalent with an action which is called sweeping or the edge effect) for preventing the developer from entering the opposing portion between the photosensitive member 1 and the charge roller 2.

A part of the developer located at the developer accumulation portion Ta is attached to and carried by the charge roller 2, and then reaches and enters a developer accumulation portion Tb located on a downstream side in a carrying direction thereof on the charge roller 2, and a part of the carried developer is discharged onto the surface of the photosensitive member 1, thus providing an equilibrium state in terms of coming and going of the developer.

In FIG. 4(*a*), a positive potential gradient is provided on the surface of the photosensitive member 1 in a direction opposite from the movement direction (a time axis direction acting on the developer accumulation portion Ta) of the photosensitive member 1.

FIG. 4(*b*) is a schematic illustration showing a state that the positive potential gradient (from −500 V to −300 V) approaches the developer accumulation portion Ta after time passes. In this embodiment, the developer has a negative chargeability (charge polarity), and a part of the developer at the developer accumulation portion Ta is attracted on a higher potential side of the positive potential gradient.

FIG. 4(*c*) is a schematic illustration showing a state that time further passes and the potential gradient is subjected to charging with the charge roller 2 to be made a certain level of potential. The developer attracted from the developer accumulation portion Ta in the state of FIG. 4(*c*) naturally forms again a developer accumulation portion by the rotation of the photosensitive member 1. As described above, it is possible to reduce a power forcing the developer located at the developer accumulation portion Ta into the abutting portion in a direction opposite to the movement direction of the photosensitive member 1 (the time axis direction acting on the developer accumulation portion Ta) By providing a potential gradient having a polarity opposite from the charge polarity of the toner, thus maintaining an equilibrium state in terms of coming and going of the developer.

More specifically, a positive potential gradient is provided in the case of using a negatively chargeable developer, and a negative potential gradient is provided in the case of using a positively chargeable developer. Particularly, a charge amount imparted to the photosensitive member 1 by the transfer apparatus 8 varies depending on whether the recording medium 8 is present or absent between the transfer apparatus 8 and the photosensitive member 1, thus being liable to cause a potential fluctuation at the leading end or the trailing end of the recording medium 9. Accordingly, the above-mentioned problem of streak-like image failure can be prevented by appropriately controlling the photosensitive member potential at this position (i.e., at the leading end or the trailing end of the recording medium 9).

In this embodiment, the case where the charge roller 2 as the charging member is moved in a direction counter to (opposite from) the movement direction of the photosensitive member while abutting against the photosensitive member 1 in the cleaner-less system is described but the effect of the present invention can also be attained even when the movement direction or the moving speed of the charge roller 2 is changed.

Figure 5:
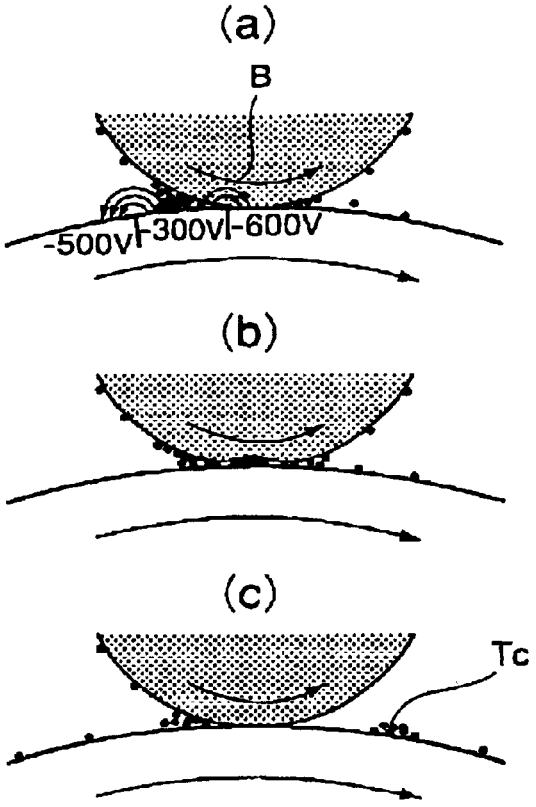
FIGS. 5(*a*) to 5(*c*) are schematic illustrations of an abutting portion between the charging member and the photosensitive member in the cleaner-less system.

FIGS. 5(*a*) to 5(*c*) are schematic sectional illustrations showing the neighborhood of a charging portion (abutting portion) between the photosensitive member 1 and the charge roller 2, where the charge roller 2 moves in a direction identical to the photosensitive member 1.

In this embodiment, if a negative potential gradient is provided by the end portion of the recording medium 9 in a direction opposite to the movement direction of the photosensitive member 1 (the time axis direction acting on the developer accumulation portion) (FIG. 5(*a*)), similarly as in the above embodiment, the potential gradient forces the developer located at the developer accumulation portion into the abutting portion between the photosensitive member and the charge roller, so that the developer enters the abutting portion beyond an electric field barrier formed before and after an acting portion to be charged by the charging member. As a result, a group of such a developer is carried toward the downstream side in the photosensitive member movement direction by the rotation of the photosensitive member (FIG. 5(*b*)), and is discharged on the photosensitive member as a streak-like developer portion Tc (FIG. 5(*c*)).

As described above, in the care where a large amount of the developer enters the abutting (opposing) portion between the charging apparatus and the object to be charged at the same time, such a problem that charging failure is caused to occur and at the same time, that the developer together entering the abutting portion blocks an optical passage to impairs image formation when it is subjected to a subsequent exposure step while remaining on the photosensitive member surface arises. Further, if a density of the developer carried on the photosensitive member surface is increased, all the developer cannot be recovered sufficiently to be visualized as image failure on a subsequent recording paper.

For this reason, even in the case where the charge roller moves at the charging (abutting) portion in a direction identical to the photosensitive member movement direction, a positive potential gradient is given at a position corresponding to an end portion of the recording medium, whereby a power of forcing the developer located at the developer accumulation portion into the charging portion is decreased to reduce an amount of discharge of the above-mentioned streak-like developer.

Further, this holds for the case where the charge member is a fixed member such as a blade or a brush.

Figure 6:
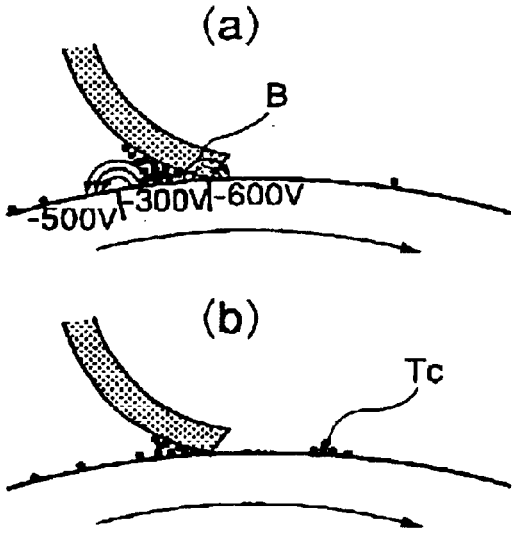
FIGS. 6(*a*) and 6(*b*) are schematic illustrations of an abutting portion between a blade-shape charging member and the photosensitive member in the cleaner-less system.

FIGS. 6(*a*) and 6(*b*) are schematic sectional views showing an abutting portion of a blade-shape charging member with a photosensitive member in the cleaner-less system.

In this embodiment, if a negative potential gradient is provided by the end portion of the recording medium in a direction opposite to the movement direction of the photosensitive member (the time axis direction acting on the developer accumulation portion) (FIG. 6(*a*)), similarly as in the above embodiment, the potential gradient forces the developer located at the developer accumulation portion into the abutting portion between the photosensitive member and the charge roller, so that the developer enters the abutting portion beyond an electric field barrier formed before and after an acting portion to be charged by the charging member, and is discharged on the photosensitive member as a streak-like developer portion Tc (FIG. 6(*b*)).

For this reason, even in the case where the charging member is the blade-shape charging member, a positive potential gradient is given at a position corresponding to an end portion of the recording medium, whereby a power of forcing the developer located at the developer accumulation portion into the charging portion is decreased to suppress an amount of discharge of the above-mentioned streak-like developer.

Further, even in the case where the charging member does not contact the photosensitive member or in the case where the charging member and the photosensitive member move in the same direction at the same speed, the above described effect of the present invention is achieved. For example, in these cases, the mechanical factor of the three factors (mechanical, spatial and electrical factors) for formation of the developer accumulation portion is reduced and is considered to be substantially removed. However, the partial factor and the electrical factor are still exist, thus leading to formation of the developer accumulation portion although an amount of the developer varies For this reason, by providing a positive potential gradient at a position corresponding to the end portion of the recording medium, a power of forcing the developer accumulation portion into the charging (abutting) portion is reduced to prevent discharge of the streak-like developer. Incidentally, an amount of the developer which reaches the charging member in a system using a cleaner is considerably smaller than that of the cleaner-less system. Accordingly, the developer accumulation phenomenon is peculiar to the cleaner-less system.

As described above, the above-mentioned effect of the present invention can be achieved in either case of non-contact charging and contact charging. In the non-contact charging, the mechanical factor for the developing accumulation portion is reduced, thus leading to a decreased amount of the developer located at the developer accumulation portion. Also in the contact charging sing the magnetic brush or fur brush, a wedge-shaped space as the spatial factor is largely changed with time, and the developer located at the developer accumulation portion is scattered by the brush. As a result, the developer accumulation portion is not stabilized to relatively reduce an amount of the developer at the accumulation portion.

Accordingly, the image forming apparatus of the present intention is particularly suitably used in the case of roller charging or powder coating contact charging resulting in a relatively large amount of the developer at the developer accumulation portion (to such an extent that a developer is recognizable on the photosensitive member through eye observation when the image forming apparatus is stopped and the charging member is separated from the charging apparatus).

(3) Comparative Embodiment 1

Figure 7:
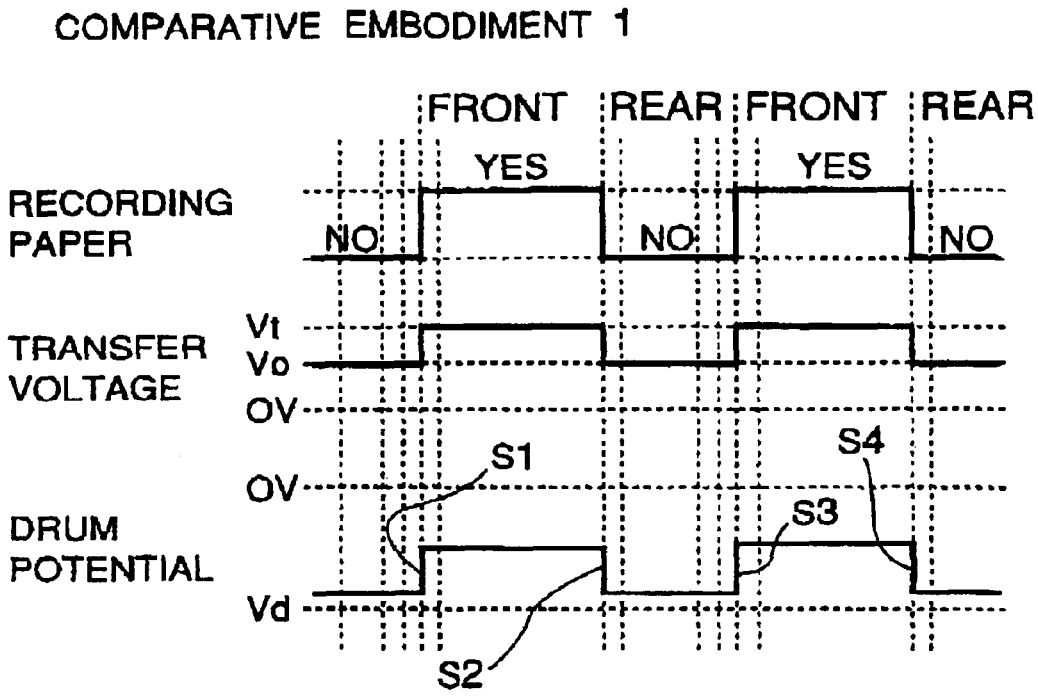
FIGS. 7, 10, 13, 15, 16 and 18–22 are respectively a sequence diagram for explaining a control operation in an image forming apparatus used in Comparative Embodiments 1 and 2, Embodiments 1 and 2, Comparative Embodiment 3, Embodiments 3 and 4, Comparative Embodiments 4 and 5, and Embodiment 5, respectively.

FIG. 7 is a control sequence diagram in Comparative Embodiment 1.

In this embodiment, a negatively chargeable developer and an image forming apparatus shown in FIG. 1 are used.

Referring to FIG. 7, the sequence diagram shows a state of the presence or absence of an A4-size plain paper as a recording medium 9, and corresponding transfer bias voltages and surface potentials of a photosensitive member (drum) at a transfer portion when two sheets of the A4-size plain paper are passed through the transfer portion.

Figure 8:
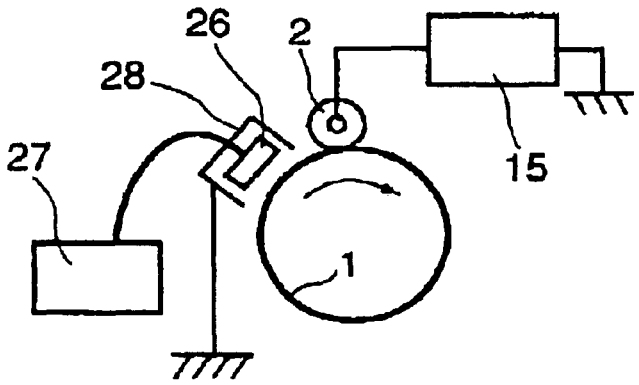
FIG. 8 is a view for explaining a potential measurement method adopted in the present invention.

FIG. 8 is a view for explaining a method of measuring a surface potential of a photosensitive member 1. In this method, members constituting an image forming apparatus are the photosensitive member 1, a charging member 2 and a high-voltage power supply 15 for supplying a bias (voltage) to the charging member 2, and other members constituting the image forming apparatus are arbitrary and different in respective embodiments. Accordingly, such other members are omitted from explanation.

Referring to FIG. 8, a surface potential meter 27 ("341HV", mfd. by Trek Co.) is used for measurement and a probe 26 is disposed 3 mm distant from the photosensitive member 1 for measuring a surface potential of the photosensitive member 1. The measuring point is set at a substantially center point in a longitudinal direction of the photosensitive member 1 within a region where the recording paper passes, a shield 28 which is grounded and formed of a metal (aluminum) may preferably be disposed around the probe so that the charging member 2 is hidden from view from the probe side, as shown in the figure.

The shield 28 is used for weakening an influence of electric line of force exerted by the charging member 2. The high-voltage power supply 15 is turned on and off in a state of rest that the rotation of the photosensitive member which has been sufficiently subjected to dark decay is stopped. If a resultant potential value is fluctuated within several ten volts, a desired shield effect is achieved. In the case where a charging voltage is changed during image formation, such a fluctuation in surface potential may preferably be suppressed within several volts by the shield effect.

The measuring point is required to be set upstream from the charging member and downstream from the potential control means in the photosensitive member movement direction, preferably be set immediately before the charging member, for the purpose of measuring the surface potential of the photosensitive member before charging.

Herein, the measurement of the photosensitive member surface potential is measured in the above manner unless otherwise specified. Further, in each sequence diagram, a change in surface potential is in correspondence with a position of a recording paper (or the photosensitive member), not with time.

Referring again to FIG. 7, in the potential control in Comparative Example 1, a transfer voltage (bias) when the recording paper is not present at the transfer portion is kept at a relatively low (weak) bias V0 (0–3000 V) so as not to damage the photosensitive member.

When the first recording paper is passed through the transfer portion, the transfer voltage is increased and shifted from the weak bias V0 to a strong bias Vt (800–5000 V) at a leading (front) end of the recording paper and is returned to the weak bias V0 at a trailing (rear) end of the recording paper.

As for the second recording paper, similarly as in the first recording paper, the strong bias Vt is applied at the leading end of the recording paper and the strong bias Vt is lowered to the weak bias V0 at the trailing end of the recording paper.

Generally, a transfer roller is prepared by forming a (resistance) layer of a resistance material having a volume resistivity of $10^4$–$10^{11}$ ohm.cm on a peripheral surface of a core metal. Transfer operation is performed by supplying a voltage to the core metal while interposing the recording paper between the surface resistance layer of the transfer roller and the photosensitive member surface. In this case, a voltage supplied to the photosensitive member when the recording paper is not present in a value obtained by subtracting a lowered voltage by voltage drop with the resistance material from a voltage applied to the core metal. Further, a surface (charge) potential of the photosensitive member given by the transfer apparatus (transfer roller) is a value after subtracting a discharge threshold value determined by the Paschen's law.

The voltage which is called the weak bias can be defined as a voltage such that a value obtained by subtracting a lowered voltage by voltage drop in the resistance layer from a voltage supplied to the transfer roller is not more than the discharge threshold value. On the other hand, the strong bias can be defined as a voltage which is not less than a voltage value obtained by adding at least a voltage corresponding to the voltage drop by the recording paper to the weak bias value since a voltage capable of electrostatically moving the developer carried on the photosensitive member surface even if the recording paper is interposed between the transfer roller an the photosensitive member.

The photosensitive member potential when the transfer voltage is the weak bias is higher than a dark-part potential (ordinarily about −600 V) of the photosensitive member by several ten volts since a degree of charging of the photosensitive member by the transfer roller is small for the above-mentioned reason. In other words, the photosensitive member potential is somewhat higher than the dark-part potential (approaches 0 V (zero volts)) due to decay from the dark-part potential and a potential corresponding to directly injected charges by the transfer roller.

When the recording paper is supplied, the photosensitive member potential exceeds the discharge threshold voltage, so that the photosensitive member is charged by the transfer roller (apparatus). As a result, the photosensitive member potential becomes a higher value than that when the recording paper is not supplied (i.e., approaches 0 V).

Accordingly, a stepwise potential difference is given at the photosensitive member surface at the time of switching the transfer voltage More specifically, referring to FIG. 7, S1 and S3 represent a positive potential difference by the transfer voltage switching at the time when the leading end of the recording paper enters the measuring point, and S2 and S4 represent a negative potential difference by the transfer voltage switching at the time when the trailing end passes through the measuring point.

Figure 9:
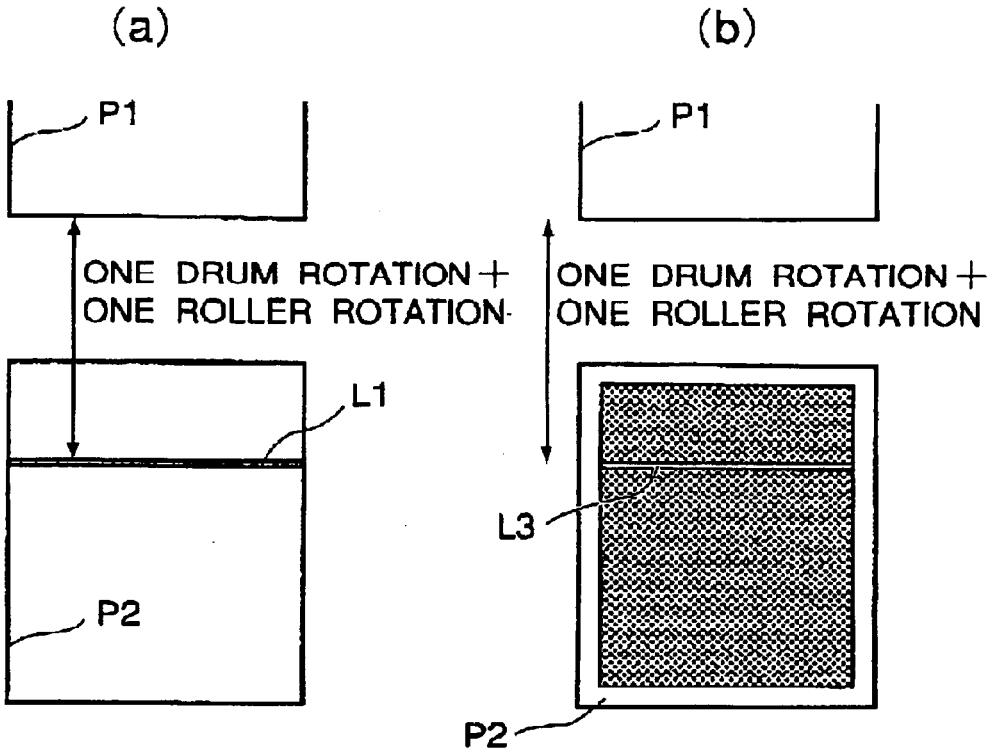
FIGS. 9(*a*) and 9(*b*) are views for illustrating a state of an occurrence of image failure.

If such a stepwise potential difference is given, the image failure as shown in FIG. 9 is caused to occur in some cases.

More specifically, due to the negative potential difference provided on the photosensitive member at the trailing end of the recording paper R1, the above-mentioned streak-like developer portion is formed on the photosensitive member. If a density of the developer carried on the photosensitive member is high, all the developer carried on the photosensitive member is not fully recovered by cleaning simultaneous with developing. As a result, a developer streak L1 is visualized as image failure on a subsequent recording paper P2 (FIG. 9(*a*)).

Such a phenomenon is noticeably observed when an image formation with a low printing ratio is performed on a subsequent recording paper.

On the other hand, when a high printing ratio-image formation is performed on a subsequent recording paper, image failure as shown in FIG. 9(*b*) is caused to occur.

More specifically, the above-mentioned streak-like developer portion is formed on the photosensitive member due to the negative potential difference provided on the photosensitive member at the trailing end of a preceding recording paper P1. This developer portion is then subjected to the exposure step while being remaining on the photosensitive member, thus blocking the light exposure to the photosensitive member to impair formation of an electrostatic latent image to be recorded on a subsequent recording paper P2. At the associated portion, a supply of the developer is reduced to lower an image density compared with other portions, thus causing a white streak L3.

Each of the streaks L1 and L3 occurs on the subsequent recording paper P2 at a position which is distant from the trailing end of the preceding recording paper P1 by a certain length determined by adding a length of the photosensitive member which moves forward in a period of one full rotation of the charge roller to a length corresponding to one full rotation of the photosensitive member.

(4) Comparative Embodiment 2

Figure 10:
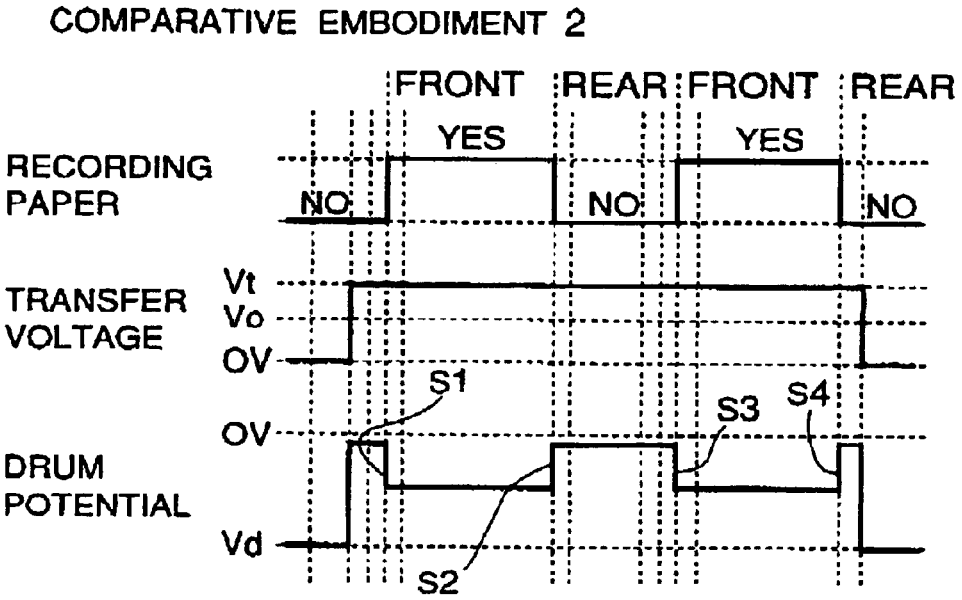

FIG. 10 shows a control sequence diagram in Comparative Example 2.

In this embodiment, a negatively chargeable developer and an image forming apparatus shown in FIG. 1 are used.

Referring to FIG. 10, the sequence diagram shows a state of the presence or absence of an A4-size plain paper as a recording medium 9, and corresponding transfer bias voltages and surface potentials of a photosensitive member (drum) at a transfer portion when two sheets of the A4-size plain paper are passed through the transfer portion.

A transfer voltage is in off-state (0 V) before a first recording paper reaches a transfer portion, and a strong bias Vt is applied before a leading end of the first recording paper is maintained during the recording paper passes the transfer position. If there is no subsequent recording paper, the transfer voltage is removed (i.e., becomes 0 V) after a trailing end of the recording paper passes through the transfer position. At this time, a photosensitive member potential is changed as shown in FIG. 10.

More specifically, the photosensitive member potential becomes a value higher than a dark-part potential Vd since the transfer bias is changed to the strong bias Vt before the first recording paper reaches the transfer portion.

When the leading end of the recording paper reaches the transfer position, a voltage drop occurs on the recording paper to lower the photosensitive member potential (i.e., approaches to Vd). After the trailing end of the recording paper passes through the transfer position the voltage drop on the recording paper is removed to increase the photosensitive member potential. On a subsequent (second) recording paper, the photosensitive member potential is similarly fluctuated.

The transfer voltage is changed to 0V after the trailing end of the subsequent recording paper passes through the transfer position, whereby the photosensitive member potential is returned to the dark-part potential Vd.

In the control of this embodiment (Comparative embodiment 2), transfer electric charges supplied to the photosensitive member fluctuate depending on whether the recording paper is present or not even at a constant transfer voltage. As a result, at the leading ends of the first and second recording papers, the negative potential differences S1 and S3 are created, respectively. At the trailing ends of the first and second recording papers, the positive potential differences S2 and S4 are created, respectively.

Figure 11:
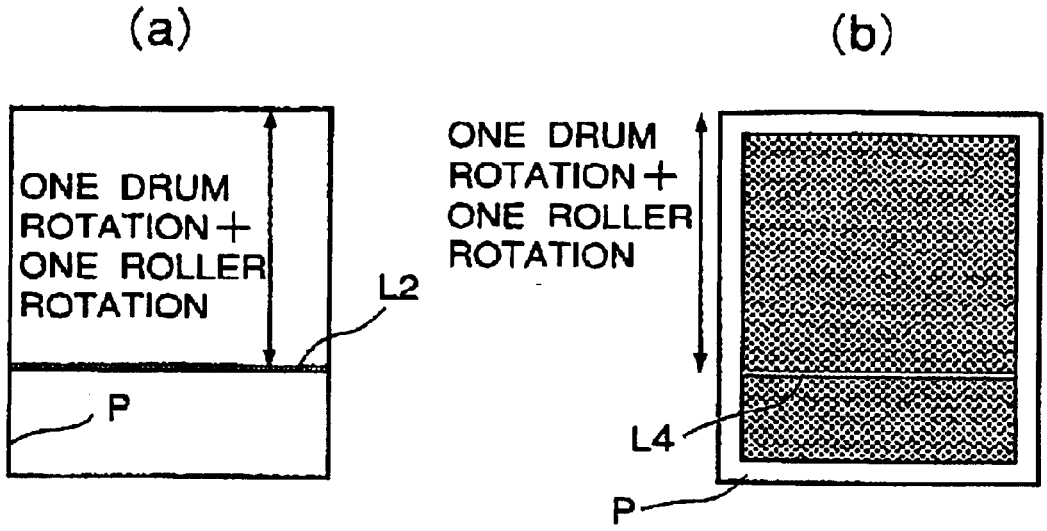
FIGS. 11(*a*) and 11(*b*) are views for illustrating a state of an occurrence of image failure.

If such a stepwise potential difference is given, the image failure as shown in FIG. 11 is caused to occur in some cases. More specifically, due to the negative potential difference provided on the photosensitive member at the leading end of the preceding (first) recording paper P1, the above-mentioned streak-like developer portion is formed on the photosensitive member. If a density of the developer carried on the photosensitive member is high similar as in Comparative Embodiment 1, all the developer carried on the photosensitive member is not fully recovered by cleaning simultaneous with developing. As a result, a developer streak L2 is visualized as image failure on the recording paper (FIG. 11(*a*)).

Such a phenomenon is noticeably observed when an image formation with a low printing ratio is performed on a subsequent recording.

On the other hand, when a high printing ratio-image formation is performed, image failure as show in FIG. 11(*b*) is caused to occur.

More specifically, the above-mentioned streak-like developer portion is formed on the photosensitive member due to the negative potential difference provided on the photosensitive member at the leading end of the preceding recording paper P1. This developer portion is then subjected to the exposure step while being remaining on the photosensitive member, thus blocking the light exposure to the photosensitive member to impair formation of an electrostatic latent image to be recorded on the recording paper P. At the associated portion, a supply of the developer is reduce to lower an image density compared with other portions, thus causing a white streak L4.

Each of the streaks L2 and L4 occurs on the recording paper P at a position which is distant from the leading end of the recording paper F by a certain length determined by adding a length of the photosensitive member which moves forward in a period of one full rotation of the charge roller to a length corresponding to one full rotation of the photosensitive member.

(5) Embodiment 1

Figure 12:
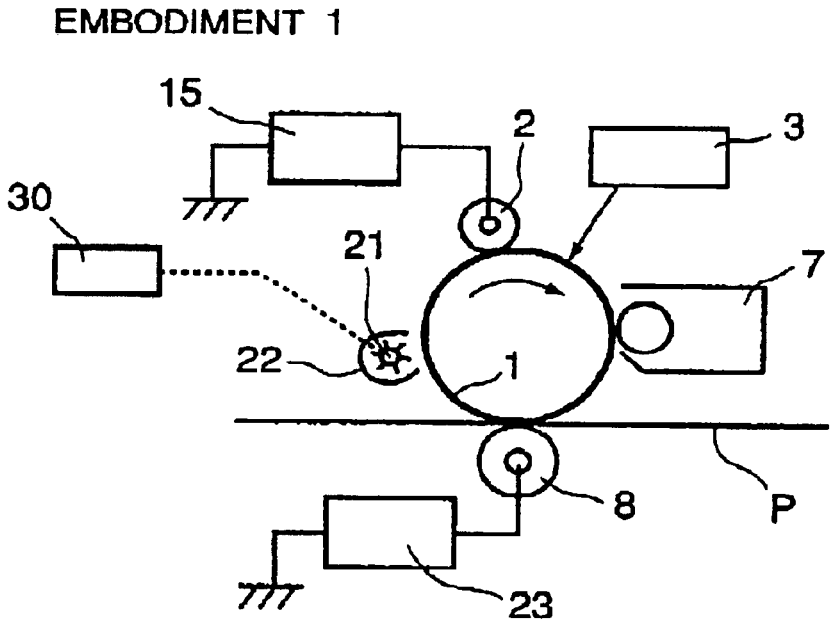
FIGS. 12, 14 and 17 are respectively a schematic sectional view of an image forming apparatus used in Embodiments 2, 3 and 4, respectively.

FIG. 12 shows a schematic sectional view of a characteristic portion of an image forming apparatus according to Embodiment 1.

Referring to FIG. 12, a photosensitive member 1 rotates in a direction of an arrow in the figure and is uniformly charged to −600 V (dark-part potential Vd) by a charge roller 2 as a charging member which is supplied with a voltage from a high-voltage power supply 15. On the photosensitive member 1, an electrostatic latent image is formed by a latent image forming means 3 and is visualized by a developing apparatus 7. At an opposing portion between a transfer roller 8 and the photosensitive member 1, a recording paper P enters at a predetermined timing, whereby the visualized developer image is electrostatically transferred onto the recording paper P. The transfer roller 8 is supplied with a transfer voltage from a high-voltage power supply 23.

An exposure light source 21 covered with a reflection plate 22 is disposed opposite to the photosensitive member 1. A control circuit unit 30 for sequentially control the image forming apparatus controls an emitted light quantity from the exposure light source 21 at a predetermined timing.

The photosensitive member 1 after being subjected to exposure to light by the exposure light source 21 is again charged by the charging roller 2 to enter a subsequent image formation cycle.

Figure 13:
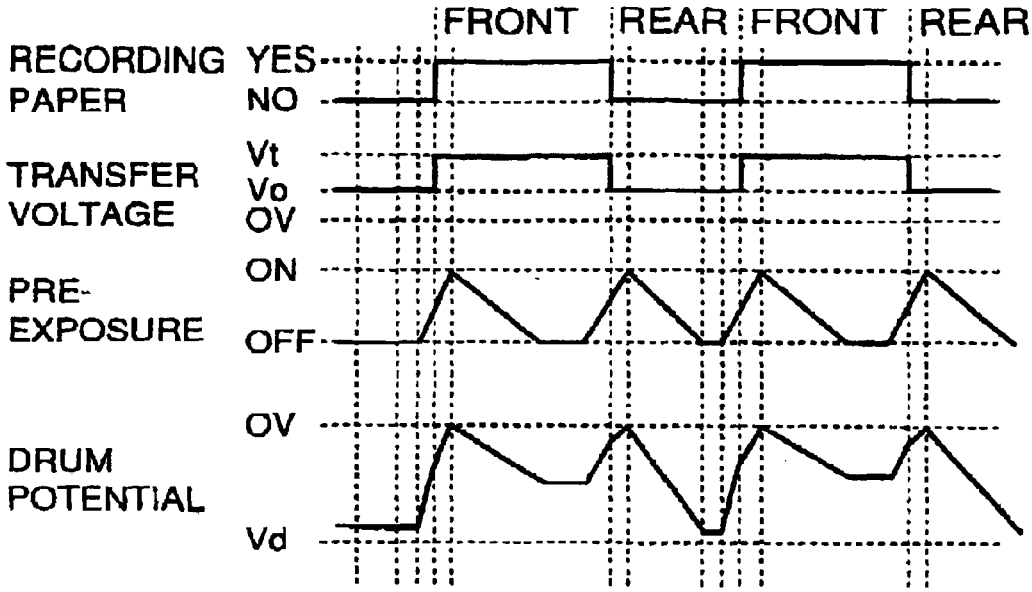

FIG. 13 shows a control sequence diagram in this embodiment.

Referring to FIG. 13 at a transfer position, a transfer voltage is a weak bias when there is no recording paper and is changed to a strong bias when the recording paper is present at the transfer position, similarly as in Comparative Embodiment 1. Pre-exposure operation indicated in FIG. 13 represents a control of the exposure light source 21. More specifically, on the basis of a position where a leading end of the recording paper contacts or abuts on the photosensitive member at the transfer position, when the position reaches a position of the exposure light source 21, an exposure light quantity is controlled as shown in FIG. 13.

Further, in FIG. 13, a drum potential (photosensitive member potential) is indicated for the drum potential after being subjected to the above-mentioned exposure similarly on the basis of the abutting position of the leading end of the recording paper with the photosensitive member. A resultant potential gradient moves toward the charge roller 2. The pre-exposure is effected in such a manner that light emission is started before the leading end of the recording paper reaches the exposure position, and a light quantity is gradually increased and then is further increased even after the leading end of the recording paper reaches the exposure position. Thereafter, during the recording paper is present at the exposure position, the light quantity is decreased at a more moderate degree than the case of increasing the light quantity, and then the exposure light source is turned off. Then, light emission is again started before the trailing end of the recording paper reaches the exposure position, and the light quantity is gradually increased and then is further increased even after the trailing end of the recording paper reaches the exposure position. Thereafter, the light quantity it decreased at a more moderate degree than the case of increasing the light quantity, and then the exposure light source is turned off.

With respect to subsequent recording papers, the above-described cycle is repeated.

The resultant photosensitive member potential is shown in FIG. 13 when such a control is performed. The photosensitive member potential starts to increase (approaches to 0 V) before the leading end of the recording paper reaches the exposure position and is still increased even after the recording paper enters the exposure position, although a slope of the increase is slight changed. During this period, a positive potential gradient is kept. Thereafter, due to the decrease in light quantity, on the recording paper passing the potential approaches to the dark-part potential Vd at a moderate negative potential gradient. Then, the light emission starts again when the trailing end of the recording paper approaches to the exposure position, and the photosensitive member potential is increased. The photosensitive member potential is further increased to keep a positive potential gradient even after the recording paper trailing end passes through the exposure position, although a slope of the increase is slightly changed. Thereafter, when the light quantity starts to be decreased in an internal of the recording paper passing, the potential approaches to the dark-part potential Vd at a moderate negative potential gradient, followed by repetition of the above-mentioned cycle.

By effecting the above-mentioned control in this embodiment, it becomes possible to provide a positive potential gradient at the leading end and the trailing end of the recording paper liable to cause an occurrence of a stepwise potential difference. As a result, it is possible to prevent the occurrence of image failure, as in Comparative Example 1, due to the stepwise potential difference at the recording paper trailing end. Further, it is also possible to suppress the image failure, due to the stepwise potential difference at the recording paper leading end, occurred in Comparative Example 2 by the control of this embodiment. In this embodiment, the moderate negative potential gradients are provided at portions other than the leading end and the trailing end of the recording paper, whereby a moderate pressure is applied to the developer accumulation portion to gradually discharge the developer located at the accumulation portion. If an amount of such a discharged developer is small, the light exposure for forming the electrostatic latent image is not interrupted. Further, such a small amount of the discharged developer can be recovered by the cleaning simultaneous with developing, thus leading to no image failure on the recording paper.

A value of the potential gradient at the time of gradually discharging the developer may preferably be a negative value which is not more than 300 V/mm in terms of absolute value, more preferably not more than 50 V/mm. If the potential gradient value is a negative value exceeding 300 V/mm in terms of absolute value, there is a possibility that the streak-like image failure is undesirably caused to occur.

Measurement of the potential gradient is performed in the following manner.

First, similarly as in Comparative Embodiment 1, the photosensitive member potential is measured to record a change in potential by an appropriate data recorder, such as an oscilloscope or a pen recorder. Then, a ratio (V/s) of the recorded change in potential is divided by a movement speed (mm/s) of the photosensitive member to be converted into a potential change (potential gradient) per unit moving length (V/mm).

(6) Embodiment 2

Figure 14:
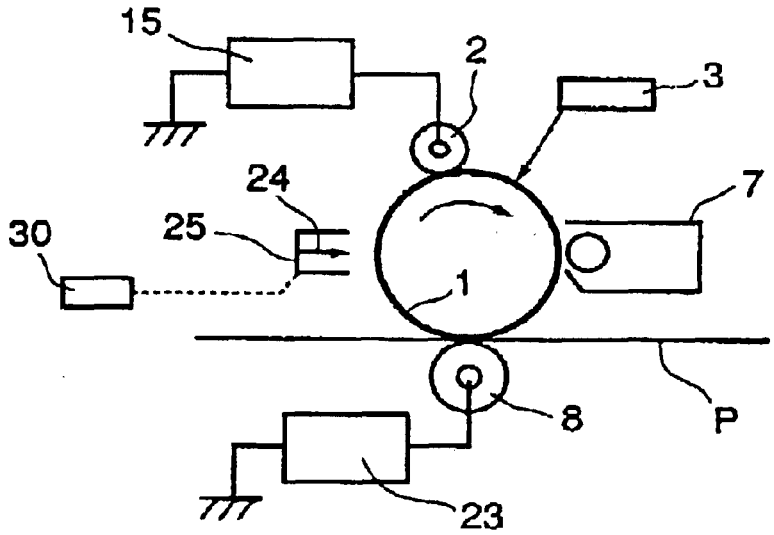

FIG. 14 shows a schematic sectional view of a characteristic portion of an image forming apparatus according to Embodiment 2.

Referring to FIG. 14, a photosensitive member 1 rotates in a direction of an arrow in the figure and is uniformly charged by a charge roller 2 as a charging member which is supplied with a voltage from a high-voltage power supply 15. On the photosensitive member 1, an electrostatic latent image is formed by a latent image forming means 3 and is visualized by a developing apparatus 7. At an opposing portion between a transfer roller 8 and the photosensitive member 1, a recording paper P enters at a predetermined timing, whereby the visualized developer image is electrostatically transferred onto the recording paper P. The transfer roller 8 is supplied with a transfer voltage from a high-voltage power supply 23.

A needle-like electrode 24 covered with a shield electrode 25 is disposed opposite to the photosensitive member 1 after the transfer step. A control circuit unit 30 for sequentially control the image forming apparatus controls a bias applied to the needle-like electrode 24 at a predetermined timing.

The photosensitive member 1 after being subjected to charging by an auxiliary charging apparatus as a charging means comprising the needle-like electrode 24 and the shield electrode 25 is again charged by the charging roller 2 to enter a subsequent image formation cycle.

Figure 15:
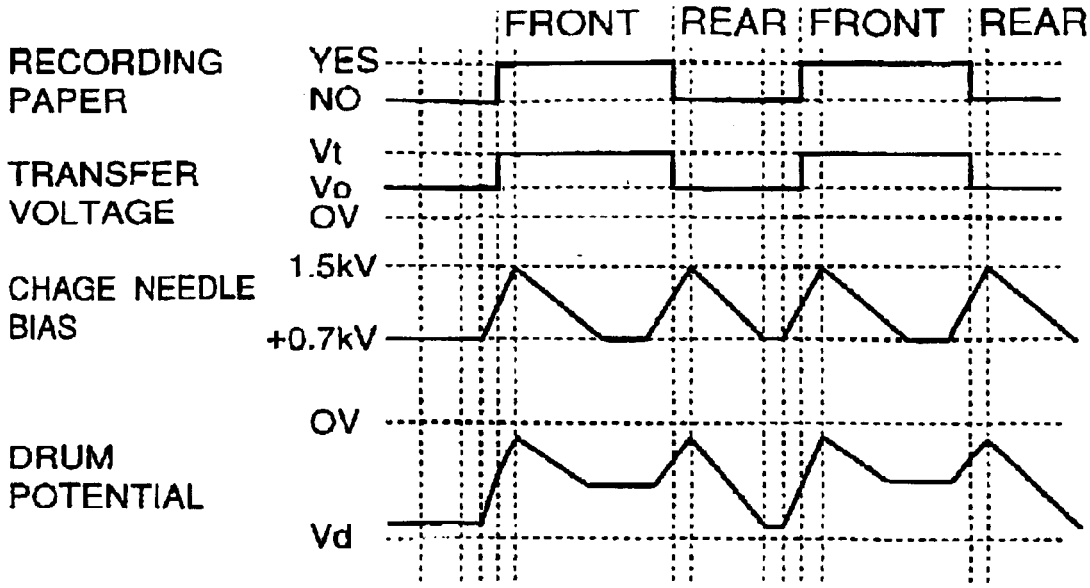

FIG. 15 shows a control sequence diagram in this embodiment.

Referring to FIG. 15 at a transfer position, a transfer voltage is a weak bias when there is no recording paper and is changed to a strong bias when the recording paper is present at the transfer position, similarly as in Comparative Embodiment 1. Charge needle bias application operation indicated in FIG. 15 represents a control of the auxiliary charging apparatus 24 and 25. More specifically, on the basis of a position where a leading end of the recording paper contacts or abuts on the photosensitive member at the transfer position, when the position reaches a position of the auxiliary charging apparatus 24 and 25, a charge needle bias (voltage) is controlled as shown in FIG. 15.

Further, in FIG. 15, a drum potential (photosensitive member potential) is indicated for the drum potential after being subjected to the above-mentioned auxiliary charging similarly on the basis of the abutting position of the leading end of the recording paper with the photosensitive member. A resultant potential gradient moves toward the charge roller 2.

The auxiliary charging utilizes an electrical discharge phenomenon and employs a discharge threshold value of bout 700 V. If a voltage of not less than 700 V is applied to the charging needle 24, the photosensitive member 1 is electrically charged. The auxiliary charging operation is effected in such a manner that application of a voltage of not less than the discharge threshold voltage is started before the leading end of the recording paper reaches the auxiliary charging position, and the applied voltage is gradually increased and then is further increased even after the leading end of the recording paper reaches the auxiliary charging position. Thereafter, during the recording paper is present at the auxiliary charging position, the applied voltage is decreased to a value below the discharge threshold value at a more moderate degree than the case of increasing the applied voltage. Then, application of a voltage of not less than the discharge threshold value is again started before the trailing end of the recording paper reaches the auxiliary charging position, and the applied voltage is gradually increased and then is further increased even after the trailing end of the recording paper reaches the auxiliary charging position. Thereafter, the applied voltage is decreased to a value below the discharge threshold value at a more moderate degree than the case of increasing the applied voltage.

With respect to subsequent recording papers, the above-described cycle is repeated.

The resultant photosensitive member potential (drum potential) at a position immediately before the charging portion is shown in FIG. 15 when such a control is performed. Measurement of the potential is performed in the same manner as in Embodiment 1.

The photosensitive member potential starts to attenuate (approaches to 0 V) before the leading end of the recording paper reaches the auxiliary charging position and is still continuously attenuated even after the recording paper enters the auxiliary charging position. During this period, a positive potential gradient is kept. Thereafter, due to the decrease in applied voltage, on the recording paper passing the potential approaches to the dark-part potential Vd at a moderate negative potential gradient. Then, the voltage application starts again when the trailing end of the recording paper approaches to the auxiliary charging position, and the photosensitive member potential is increased. The photosensitive member potential is further increased to keep a positive potential gradient even after the recording paper trailing end passes through the auxiliary charging position. Thereafter, when the applied voltage starts to be decreased in an internal of the recording paper passing, the potential approaches to the dark-part potential Vd at a moderate negative potential gradient, followed by repetition of the above-mentioned cycle.

By effecting the above-mentioned control in this embodiment, it becomes possible to provide a positive potential gradient at the leading end and the trailing end of the recording paper liable to cause an occurrence of a stepwise potential difference. As a result, it is possible to prevent the occurrence of image failure, as in Comparative Example 1, due to the stepwise potential difference at the recording paper trailing end. Further, it is also possible to suppress the image failure, due to the stepwise potential difference at the recording paper leading end, occurred in Comparative Example 2 by the control of this embodiment. In this embodiment, similarly as in Embodiment 1, the moderate negative potential gradients are provided at portions other than the leading end and the trailing end of the recording paper, whereby a moderate pressure is applied to the developer accumulation portion to gradually discharge the developer located at the accumulation portion. If an amount of such a discharged developer is small, the light exposure for forming the electrostatic latent image is not interrupted. Further, such a small amount of the discharged developer can be recovered by the cleaning simultaneous with developing, thus leading to no image failure on the recording paper.

In the case of using the exposure means 21 and 22 as in Embodiment 1, the photosensitive member potential after the exposure is changed by the photosensitive member potential before the exposure in some cases even at the same exposure light quantity.

However, in this embodiment, the photosensitive member is charged, so that it becomes possible to control the potential gradient, irrespective of the photosensitive member potentials before and after the auxiliary charging. As a result, it becomes possible to effect a further accurate potential gradient control.

In order to prevent contamination with the developer, the auxiliary charging means 24 and 25 may preferably be disposed in a noncontact state with the photosensitive member 1. Accordingly, the auxiliary charging means may be the above-mentioned ordinary corona charger. Further, the auxiliary charging means 24 and 25 may be charge-removing or charging means, capable of changing a surface potential of the photosensitive member 1, disposed between the transfer means (roller) 8 and the charging member (roller) 2. Accordingly, it is also possible to use a separation and charge-removing apparatus ordinarily used for an image forming apparatus for the purpose of assisting separation of the recording paper from the photosensitive member 1. However, in view of a decrease in resolving power (available maximum slope) for potential control when the apparatus is distant from the photosensitive member 1, it is preferred that means for the purpose of this embodiment is disposed close to the photosensitive member 1 as described above, in order to effect a high-accuracy potential control.

(7) Comparative Embodiment 3

Figure 16:
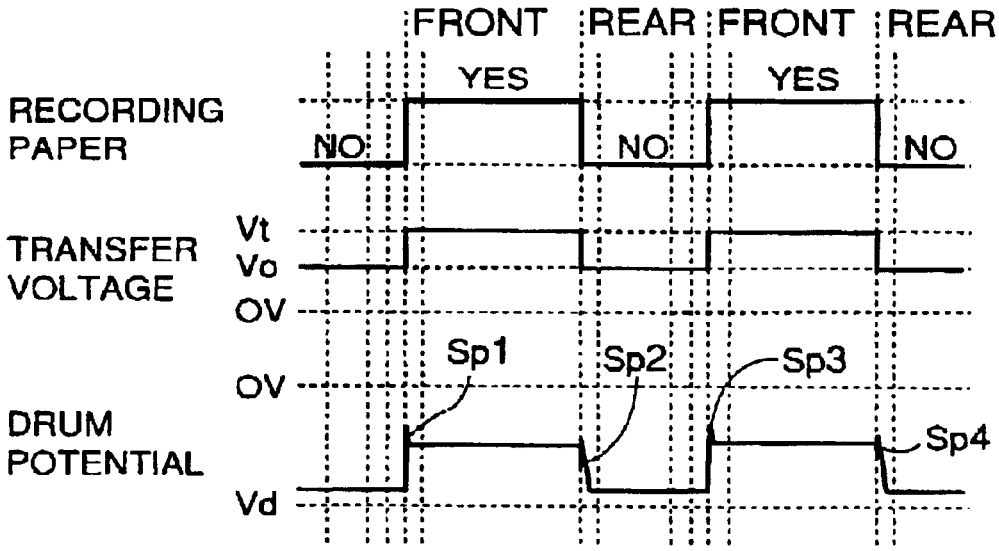

FIG. 16 shows a control sequence diagram in this embodiment wherein a photosensitive member potential change immediately before charging when a recording paper as a recording material is left standing for a long period (one week) in a low-temperature/low-humidity environment (15° C./10% RH) is shown, and the control similarly as in Comparative Embodiment 1 is performed.

When the recording paper is in a dry state as in this embodiment, the recording paper is liable to be triboelectrically charged. As a result, when an end of the recording paper enters a transfer position, electrical discharge is liable to occur at the end of the recording paper on the photosensitive member. As mentioned above, particularly, the end of the recording paper has a sharp form, thus being liable to cause electric field concentration. When the discharge is once caused to occur, a relatively large potential difference is generated on the photosensitive member.

Referring to FIG. 16, Sp1 represents a stepwise potential difference due to a spike generated at a position of the photosensitive member corresponding to a leading end position of the preceding recording paper, Sp2 represents a stepwise potential difference at a position corresponding to a trailing end position of the preceding recording paper, Sp3 represents a stepwise potential difference at a position corresponding to a leading end position of the subsequent recording paper, and Sp4 represents a stepwise potential difference at a position corresponding to a trailing end position of the subsequent recording paper.

These potential differences vary depending on an entering state of the recording paper leading end into the transfer position, a degree of curling at the leading end, paper thickness, etc., and exhibit random behavior like noises in many cases. Of these potential differences, a larger negative potential gradient can be created, thus causing the above-mentioned streak-like image failure both at the leading end and the trailing end of the recording paper in some cases.

(8) Embodiment 3

As Embodiment 3 of the present invention, the case where a transfer means 8 also functions as a potential control means of the photosensitive member 1 in an image forming apparatus shown in FIG. 17 will be explained.

Figure 17:
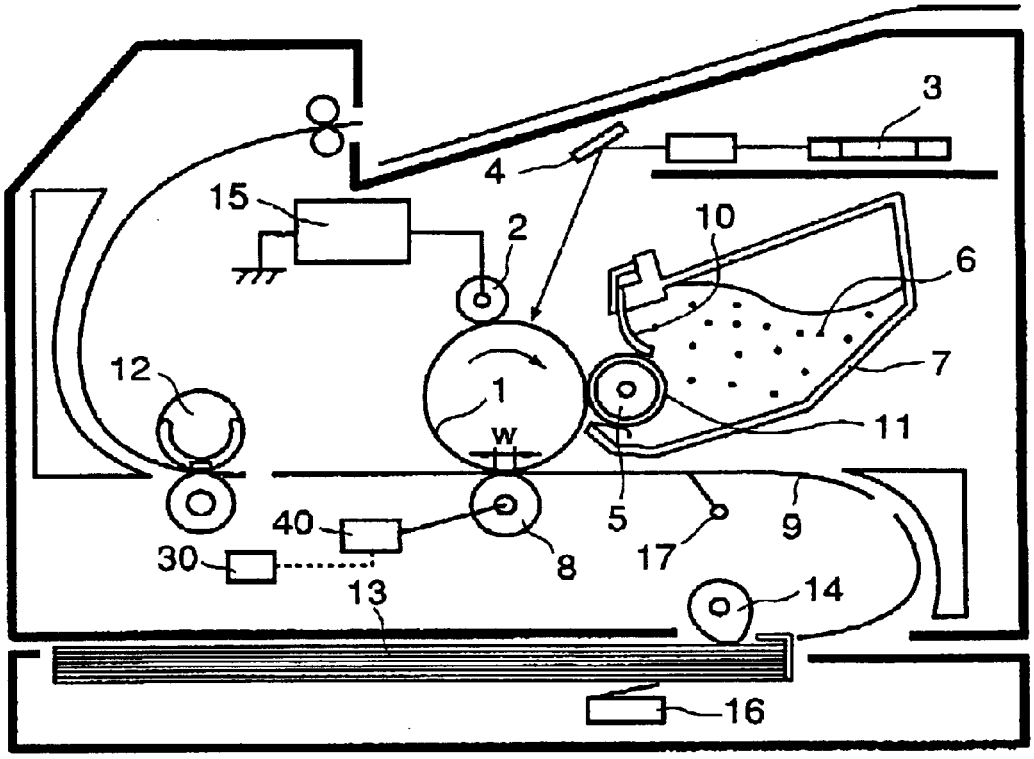

Referring to FIG. 17, a transfer roller to be supplied with a bias is used as a transfer means 8, and is formed in a roller shape by forming an elastic resistance layer having a length of 220 mm on a core metal (SUS stainless steel) having a diameter of 6 mm and a length of 240 mm.

The elastic resistance layer comprises a rubber material such a EPDM or NBR, and electroconductive particles of metal oxide or ion conductive material dispersed in the rubber material together with a foaming agent etc. The elastic resistance layer is formed in a sponge shape through a vulcanization foaming step.

The transfer roller may preferably have an electrical resistance of $10^4$–$10^{12}$ ohm, and in this embodiment, the transfer roller used has an electrical resistance of $1\times10^9$ ohm.

The electrical resistance of the transfer roller is measured in the following manner.

The elastic portion of the transfer roller is pressed against an aluminum drum (ϕ=30 mm) throughout its length at a pressure of 9.8N, and a voltage of 2 kV is applied between the core metal of the transfer roller and the aluminum drum. The resistance of the transfer roller is calculated from resulting current flowing at the time of the voltage application.

In this embodiment, the transfer roller has an ASKER C-hardness of 29 degrees under a load of 9.8N and is abutted against the photosensitive member (drum) at an abutting pressure of 7N. At that time, a nip width (an abutting width between the photosensitive drum and the transfer roller) is 4 mm.

The transfer roller 8 is supplied with a voltage from a high-voltage power supply 40. A control circuit 30 for effecting a sequence control of the image forming apparatus controls a bias (voltage) to be applied to the transfer roller at a predetermined timing in this embodiment, a control sequence diagram for the transfer high-voltage power supply 40 is shown in FIG. 18.

Figure 18:
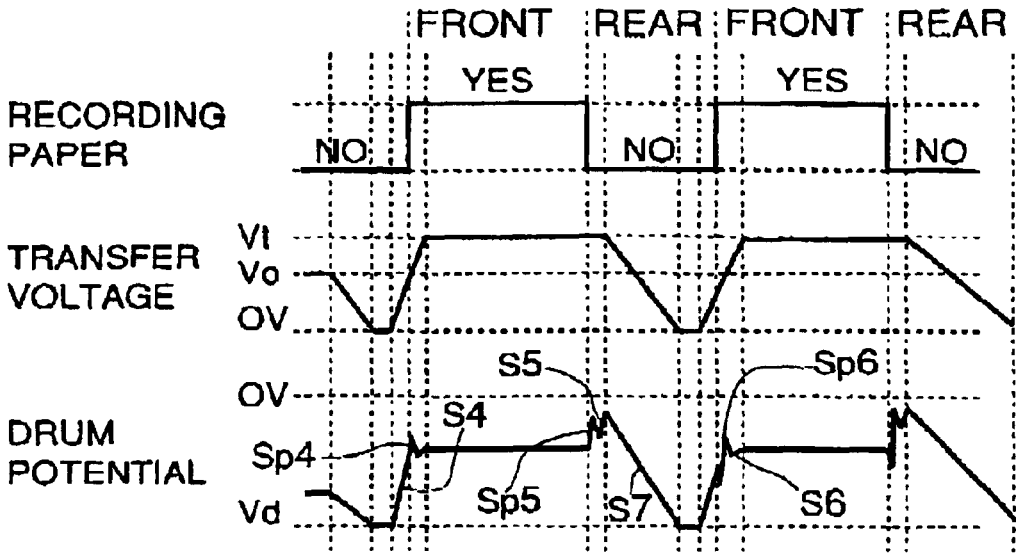

Referring to FIG. 18, at a position where there is no recording paper, a transfer voltage is decreased from a weak bias V0 (1200 V in this embodiment) to 0 V at a relatively moderate rate (−28 V/mm in this embodiment, a degree of change in applied transfer voltage per unit distance in a direction opposite from the movement direction of the photosensitive member 1), and then starts to increase at a rate of 300 V/mm before the recording paper enters the transfer position. The transfer voltage continuously increases even after the leading end of the recording paper enters the transfer position until it reaches a strong transfer bias Vt (3000 V in this embodiment) and then is kept at Vt. Even after the trailing end of the recording paper passes through the transfer position, Vt is still kept, and then is moderately decreased to 0 V (at −70 V/mm). Then, the transfer voltage is again increased continuously at a rate of 300/mm up to Vt (strong bias) even after the recording paper leading end reaches the transfer position. This control operation is repeated with respect to a subsequent recording paper.

The photosensitive member potential change when a dry recording paper is fed is shown in FIG. 18.

Before the recording paper reaches the transfer position, the photosensitive member potential has a moderate negative potential gradient. The photosensitive member potential has a positive potential gradient S4 (30 V/mm, a degree of change in potential per unit distance in a direction opposite from the photosensitive member movement direction) at the leading end of the recording paper. When the recording paper leading end enters the transfer position, a potential spike Sp4 is generated but a negative potential difference component is decreased since the photosensitive member potential is increased, and on the other hand, a positive potential difference is amplified. After the recording paper trailing end passes through the transfer position, a voltage drop by the recording paper is removed, so that the photosensitive member potential is increased at a positive potential gradient S5 (100 V/mm). At that time, a potential spike Sp5 generated at the trailing end of the recording paper also shows such a characteristic that a negative potential difference component is decreased and a positive difference is amplified. Thereafter at an interval of paper feeding, the photosensitive member potential has a moderate negative potential gradient S7 (−12 V/mm). A similar potential change is repeated with respect to a subsequent recording paper.

In this embodiment, the transfer means 8 also functions as the potential control means of the photosensitive member 1, so that it is possible to decrease the negative potential difference component of the potential spike at the leading end and the trailing end of the recording paper. As a result, it becomes possible to reduce the streak-like image failure as generated in Comparative Embodiment 3 due to the discharge at the leading end and the trailing end of the recording paper.

Further, as described above, a negative potential gradient E2 (S7=−12 V/mm in this embodiment) smaller in absolute value than a positive potential gradient E1 (S4=30 V/mm at the leading end, S5=100 V/mm at the trailing end) is provided in a region other than the recording paper leading end, the developer located at the developer accumulation portion is gradually discharged and recovered by the developing apparatus in such a state that the photosensitive member potential is stable. As a result, it becomes possible to prevent an occurrence of image failure while effecting cleaning of the charging member.

In order to achieve such an effect, the relationship: E1>0>E2 and |E1|>|E2| are satisfied for a negatively chargeable developer, and the relationship; E1<0<E2 and |E1|>|E2| are satisfied for a positively chargeable developer. The absolute value of E2 may preferably be not more than 300 V/mm, particularly not more than 50 V/mm.

In this embodiment, a sponge roller is used as the transfer member but a solid roller is also applicable thereto in order to obtain the above effect. The solid roller generally has a higher hardness than the sponge roller, so that the abutting nip width with the photosensitive member becomes narrower, thus preferably allowing a better adjustment of the photosensitive member potential with accuracy.

Further, the effect of this embodiment is attained not only by the contact-type transfer means but also a noncontact-type transfer means utilizing corona discharge, etc. However, if a noncontact-type electrostatic transfer means tends to provide a larger acting width (transfer nip width), thus being difficult to effect an abrupt potential control. Accordingly, the contact-type transfer means may preferably be used in the present invention.

As described above, in this embodiment, the transfer means also functions as the potential control means of the photosensitive member (drum), thus leading to a simple construction. Particularly, if a contact type transfer roller is used as the transfer means, the acting (transfer nip) width becomes narrower than the cases of Embodiments 1 and 2 described above. Consequently, it becomes possible to provide an accurate and abrupt potential gradient thereby to cancel a larger potential spike.

(9) Embodiment 4

A potential gradient varies depending on an irregularity in electrical resistance of a transfer roller in some cases when a transfer roller including a resistance layer having a higher electrical resistance is used.

Figure 19:
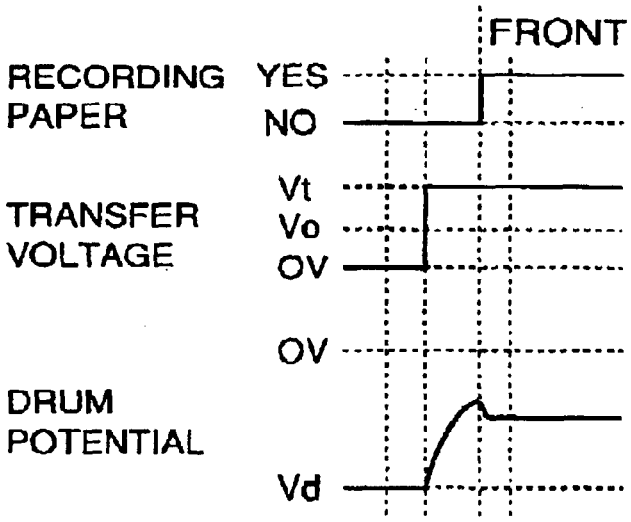

For example, FIG. 19 shows a control sequence diagram in this embodiment wherein the transfer roller has a larger electrical resistance of $10^{11}$ ohm.

Referring to FIG. 19, a transfer voltage is abruptly increased up to a strong bias Vt before the recording paper reaches the transfer position but the transfer roller has a high electrical resistance, so that a time constant for charging the photosensitive member by the transfer means becomes large. As a result, the photosensitive member potential is moderately increased to reduce a negative potential gradient at the leading end of the recording paper in this embodiment, a streak-like image failure is not caused to occur.

Incidentally, when the image forming apparatus is used for a long period of time, a developer in the vicinity of the charge roller is mixed with not only negatively chargeable developer but also a reversal developer (positively chargeable developer) in some cases. At that time, the reversal developer is recognized as the streak-like image failure in some cases if a resultant positive potential gradient is extremely large.

In this embodiment, compared with Embodiment 3, the positive potential gradient becomes smaller. As a result, it is possible to prevent the streak-like image failure even if an amount of the reversal developer is increased in the vicinity of the charging member.

(10) Comparative Embodiment 4

Figure 20:
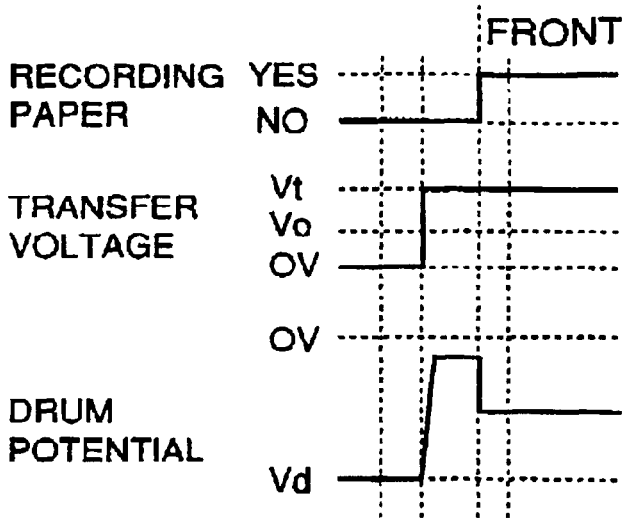

In this embodiment, a transfer voltage control is performed in the same manner as in Embodiment 4 except that a transfer roller has a lower electrical resistance of $10^5$ ohm, and a control sequence diagram thereof is shown in FIG. 20.

Referring to FIG. 20, the photosensitive member (drum) potential is in a higher state before the recording paper enters the transfer position and is decreased after the recording paper leading end enters the transfer position. Accordingly, due to the negative potential gradient, the streak-like image failure is caused to occur when the recording paper enters the transfer position.

When the transfer voltage is abruptly decreased as in this embodiment, a degree of the occurrence of streak-like image failure varies depending on an irregularity in electrical resistance value of the transfer roller. Further, if the transfer voltage is supplied after the recording paper leading end enters the transfer position, the streak-like image failure can be alleviated but a transfer of the developer image undesirably fails in some case depending on the electrical resistance of the transfer roller.

(11) Comparative Embodiment 5

Figure 21:
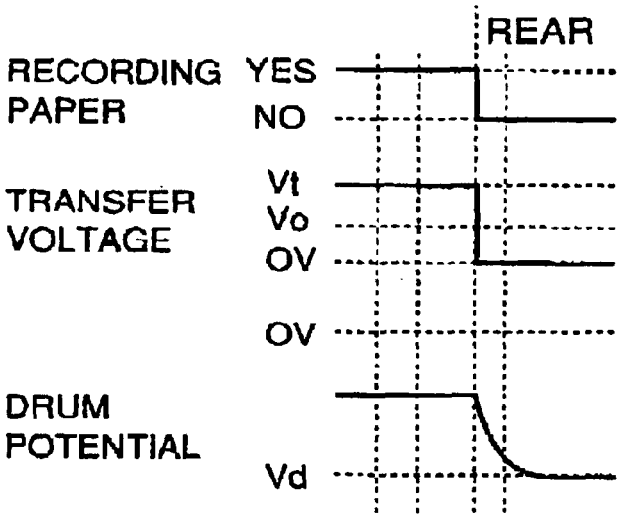

FIG. 21 shows a control sequence diagram wherein a transfer roller has a relatively high electrical resistance of $10^{11}$ ohm.

The transfer voltage is turned off simultaneously with entrance of the trailing end of the recording paper into the transfer position but it takes a time to some extent for the transfer voltage to be decreased to 0 V due to a time constant for changing the photosensitive member by the transfer means. At that time, the negative potential gradient immediately after the transfer voltage is turned off is most abrupt, thus leading to an occurrence of the streak-like image failure. In order to decrease the potential gradient to the extent that the occurrence of the streak-like image failure is suppressed, it is necessary to increase the time constant. For this purpose, e.g., the electrical resistance of the transfer roller may be further increased but an applied voltage required for transfer is also increased to result in a large-sized paper supply. Further, when the time constant is further increased, there is a possibility that transfer of the developer image fails at the time of increasing the applied voltage, so that the increase in time constant is not practical.

(12) Embodiment 5

Figure 22:
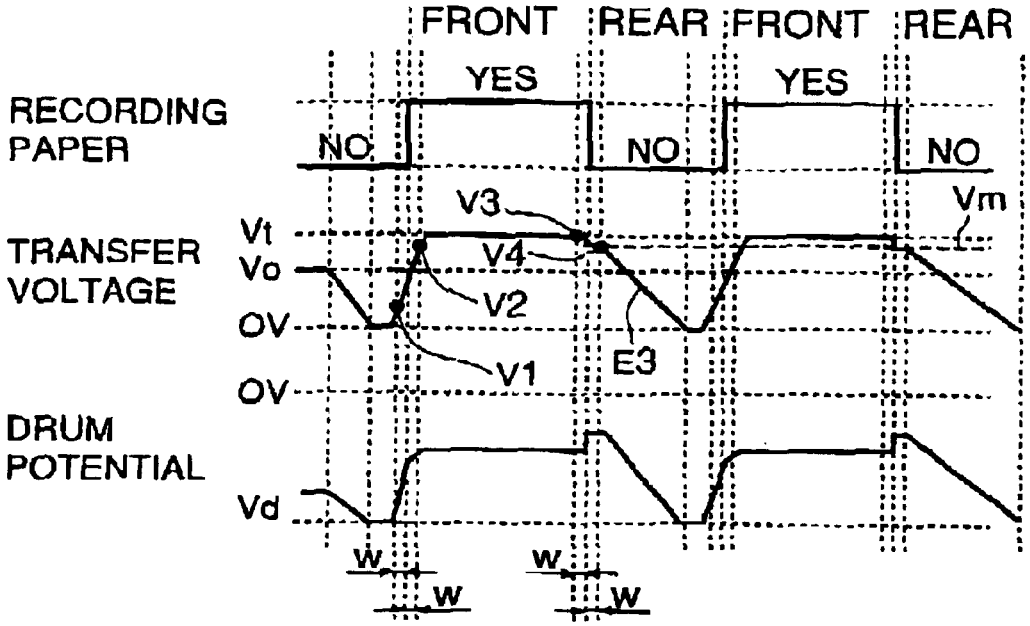

FIG. 22 shows a control sequence diagram in this embodiment wherein a recording paper is feed at a feeding speed of 85 mm/s and a transfer nip width W where a transfer roller abuts on a photosensitive member is set to 4 mm.

The transfer (abutting) nip width W is determined in the following manner.

A commercially available ink is applied onto the transfer roller, and a width of the ink attached to the photosensitive member is measured when the transfer roller is mounted to an image forming apparatus.

Referring to FIG. 22, in a movement direction of the recording paper, V1 represents a voltage applied to the transfer member (transfer roller) when a leading and of the recording material is located upstream from an upstream end of the transfer nip by W; V2 represents a voltage applied to the transfer member when the leading end of the recording material is located downstream from the upstream end of the transfer nip by W; V3 represents a voltage applied to the transfer member when a trailing end of the recording material is located upstream from a downstream end of the transfer nip by W; and V4 represents a voltage applied to the transfer member when the trailing end of the recording material is located downstream from the downstream end of the transfer nip by W.

In this embodiment, the transfer voltage V1 and a position located before a contact position where the leading end of the recording paper contacts the photosensitive member by w is set to 300 V, and the transfer voltage V2 at a position located behind the contact position by w is set to 2700 V. Further, the transfer voltage V3 at a position located before a contact position where the trailing end of the recording paper contact position where the trailing end of the recording paper contacts the photosensitive member by W is set to 3000 V, and the transfer voltage V4 located behind the contact position by W is set to 2700 V.

The control of the transfer voltage is effected by a control circuit for sequentially controlling the image forming apparatus.

Referring to FIG. 22, in this embodiment, the transfer voltage is decreased from the strong bias Vt to Tm at the trailing end of the recording material and then is gradually decreased to 0 V. The value Vm may be defined as a voltage capable of charging the photosensitive member at a potential higher than a potential given by charging the photosensitive member with the strong bias Vt when the recording paper is present at the transfer position. The resultant photosensitive member potential, as shown in the figure, is once increased after the recording paper is passed through the transfer position and then is moderately decreased. Based on this control, an occurrence of the streak-like image failure can be suppressed. Further, when compared with the case of Embodiment 3, a voltage (Vm) lower than the strong bias Vt at the time when the recording paper trailing end passes through the transfer position is applied, whereby it is possible to alleviate a damage to the photosensitive member.

After the trailing end of the recording paper is passed through the transfer position, if the transfer voltage is abruptly decreased, a large negative potential difference is undesirably created. On the other hand, if the transfer voltage is further increased after the recording paper trailing end is passed through the transfer position, the photosensitive member is undesirably damaged. Accordingly, in the neighborhood of the trailing end of the recording paper, it is preferred that a fluctuation in transfer voltage is decreased.

Further, as mentioned above, if the recording paper is interposed between the transfer means and the photosensitive member, electrical charges supplied from the transfer means to the photosensitive member are changed due to a voltage drop by the presence of the recording paper. For this reason, in order to provide a positive potential gradient at both of the leading end and the trailing end of the recording paper, a degree of change in transfer voltage at the recording paper leading end may preferably be set to be larger than that at the recording paper trailing end. Further, the transfer nip width (W) corresponds to a limit of resolution with respect to the fluctuation in potential of the photosensitive member, so that at a position within the transfer nip width, the potential fluctuation of the photosensitive member is not affected even if an abrupt change in transfer voltage is provided. Accordingly, as in this embodiment, the setting of the transfer voltage may preferably be performed on the basis of the distance of the transfer nip width (W) from the recording paper end.

Further, if the relationship: V2>V1 is satisfied, it is possible to provide a positive potential gradient to the photosensitive member surface at the leading end of the photosensitive member even when the resistance value of the transfer roller is fluctuated.

As described above, in a preferred embodiment, when the developer used has a negative chargeability, a potential gradient of a polarity opposite from the polarity of the developer used can be created by satisfying the following relationship: V2−V1>0 and V2−V1>V3−V4 at both ends (leading end and trailing end) of the recording paper, even if the transfer roller resistance varies depending on an irregularity in production conditions. If the relationship: V2−V1>V3−V4 >0 is satisfied, the damage to the photosensitive member may further preferably be reduced.

On the other hand, when the developer used has a positive chargeability, it is preferred that the transfer voltage values may preferably satisfy the relationships: V2−V1<0 and V2−V1<V3−V4, more preferably V2−V1<V3−V4 <0.

In order to discharge the developer from the developer accumulation portion by providing a negative potential gradient at an interval of feeding the recording paper, an absolute value of a transfer potential gradient E3 at the interval is at least required to be smaller than that of the transfer potential gradient at the leading end of the recording paper. At the trailing end of the recording paper, in order to allow a margin against the discharge spike, it is preferred that the potential gradient at the interval of feeding the recording paper.

In other words, when E3 is a maximum of a potential gradient which is opposite in polarity from the charge polarity of the toner (developer), the following relationships may preferably be satisfied:

$$(V2-V1)/2W>(V4-V3)/2W>E3,$$

and $$(V2-V1)/2W>|E3|.$$

In this embodiment, E3 which is the maximum potential gradient at the paper feeding interval is −63 V/mm, (V2−V1)/2W which is the potential gradient at the recording paper leading end is 300 V/mm, and (V4−V3)/2W is −37.5 V/mm.

According to the image forming apparatus of this embodiment, it is possible to provide the photosensitive member with a positive potential gradient with reliability at the end of the recording paper even when there is a production irregularity in electrical resistance of the transfer roller. As a result, it is possible to prevent the occurrence of the streak-like image failure.

Further, it is possible to gradually remove the developer in the neighborhood of the charging means at the time other than image formation. Accordingly, even in the case where a large amount of the transfer residual toner is generated, it is possible to suppress the streak-like image failure.

In this embodiment, the transfer bias control is described based on voltage values. However, if the above-described relationships of the applied voltages at the ends of the recording paper are satisfied, in addition to the constant voltage control, it is possible to adopt known transfer control schemes using, e.g., a constant current control or a combination of the constant voltage control with the constant current control.

In the above-described Embodiments of the present invention, the case where the transfer voltage is lowered to 0 V is explained as an example but other voltage settings may also be applicable if the relationships in the respective Embodiments are satisfied.

Incidentally, Japanese Laid-Open Patent Application (JP-A) No. 2000-330400 discloses that a transfer voltage is gradually increased after a leading end of a recording paper is passed in secondary transfer operation from an intermediary transfer member. Further, JP-A Hei 11-352800 discloses that a position where a transfer voltage is applied is changed depending on a position of recording paper, and JP-A 2000-172089 (corresponding to U.S. Pat. No. 6,334,032) discloses that a transfer apparatus is controlled with a constant current at a leading end and a trailing end of recording paper.

However, these publication documents fail to provide any teachings about a direction and a slope of a potential gradient to be set at a surface of a photosensitive member, thus failing to solve the problems of the present invention.

(13) Miscellaneousness

1) In the above embodiments, the image forming apparatus is used as the laser beam printer but may be used as another image forming apparatus, such as an electrophotographic copying machine, a facsimile apparatus, a word processor, etc., or an image display apparatus, such a an electronic copyboard.

2) The exposure means for forming the electrostatic latent image is not restricted to the laser beam scanning exposure means 3 for forming a latent image in a digital manner as in the above embodiments but may be other means, such as an ordinary analog image exposure means and light-emitting devices including LED. It is possible to apply any means capable of forming an electrostatic latent image corresponding to image data, such as a combination of the light-emitting device, such a fluorescent lamp with a liquid crystal shutter.

The image bearing member as the member to be charged is an electrostatic recording dielectric body in the case of an electrostatic recording apparatus. In this case, the surface of the dielectric body is charged uniformly to a predetermined polarity and a predetermined potential and then is charge-removed selectively by charge-removing means, such as a charge removing needle array or an electron gun, thereby to form an objective electrostatic latent image by writing.

3) The image bearing member is not limited to the drum-type but may be an endless belt-type, a belt-type having an end, a sheet-type, etc.

4) The developing apparatus used in the above-mentioned embodiments is of a reversal development-type using a monocomponent magnetic toner but is not limited thereto. A normal development-type developing apparatus is also applicable.

Generally, the developing method of the electrostatic latent image may be roughly classified into four types including: a monocomponent non-contact developing method wherein a toner coated on a developer-carrying member such as a sleeve with a blade, etc., for a non-magnetic toner or coated on a developer-carrying member by the action of magnetic force for a magnetic toner is carried and applied onto the image bearing member in a non-contact state to develop an electrostatic latent image; a monocomponent contact developing method wherein the toner coated on the developer-carrying member in the above-mentioned manner is applied onto the image bearing member in a contact state to develop the electrostatic latent image; a two-component contact developing method wherein a two-component developer prepared by mixing toner particles with a magnetic carrier is carried and applied onto the image bearing member in contact state to develop the electrostatic latent image; and a two-component non-contact developing method wherein the two-component developer is applied onto the image-bearing member in a non-contact state to develop the electrostatic latent image. To the present invention, there four-types of the developing methods are applicable.

5) The transfer means is not restricted to the transfer roller but may be modified into transfer means using a belt, corona discharge, etc. Further, it is also possible to employ an intermediate transfer member (a member to be temporarily transferred) such as a transfer drum or a transfer belt, for use in an image forming apparatus for forming multi-color or full-color images by multiple-transfer operation, in addition to a monochromatic image.

6) The direct injection charging is performed on the basis of such a charging mechanism that electrical charges are directly moved from a contact charging member to an object portion to be charged. Accordingly, it is necessary for the contact charging member to fully contact the surface of the object to be charged. For this reason, it is desirable that the contact charging member is rotated to create a difference in peripheral speed with the object to be charged.

Specifically, the contact charging member is rotatively driven, independently from the object to be charged, to create a predetermined peripheral speed difference between the contact charging member and the object to be charged. Desirably, the charging member is rotated so that the rotational direction of the contact charging member at their contact portion becomes opposite to the direction in which the peripheral surface of the object to be charged moves at their contact portion.

It is also possible to create the peripheral speed difference by moving the peripheral surfaces of both the contact charging member and the object to be charged, in the same direction at their contact portion. However, the effectiveness of the charge injection is dependent upon a difference between the peripheral speeds (relative speed difference) of the contact charging member and the object to be charged, and in order to create, while moving the two surfaces in the same direction, a peripheral speed difference equal to the peripheral speed difference created by moving the two surfaces in the directions opposite to each other, the number of revolutions of the contact charging member must be rather drastically increased compared to when the two surfaces are moved in the different direction. Therefore, moving the two surfaces in the opposite directions to each other is advantageous in terms of the number of revolutions of the contact charging member. The peripheral speed difference, here, is defined as follows:

Peripheral speed difference (%)=(peripheral speed of contact charging member)−(peripheral speed of object to be charged).

In the above formula, the values of the peripheral speeds of the contact charging member are positive values object to be charged move in the same direction at the contact portion.

7) The charging member is not necessarily required to contact a surface of an image bearing member as the object to be charged. For example, the charging member may be disposed close to the image bearing member in a non-contact state with a gap (spacing) of, e.g., several ten $\mu$m to the image bearing member so long as an area, allowing discharge phenomenon, determined on the basis of a voltage in the gap and a Paschen's curve is ensured with reliability.

As described hereinabove, according to the present invention, in the cleaner-less type image forming apparatus, a degree of an occurrence of image failure in streak shape is minimized and a contamination of the charging apparatus is effectively reduced whereby high-quality images are stably attained.

The present invention is not limited to the above-described embodiments, and variations and modifications may be made within the scope of the present invention.

What is claimed is:

1. An image forming apparatus comprising:

a movable image bearing member, a charging member disposed opposed to said image bearing member, a transfer member for transferring a toner image from said image bearing member onto a recording material, and potential control means for changing a potential gradient on said image bearing member at positions corresponding to leading and trailing ends of the recording material in a direction opposite from a charge polarity of the toner with respect to a direction opposite from a movement direction of said image bearing member.

2. An apparatus according to claim 1, wherein said potential control means changes the potential gradient to have a polarity opposite from the charge polarity of the toner.

3. An apparatus according to claim 1, wherein when the potential gradient on said image bearing member at positions corresponding to leading and trailing ends is E1 and a potential gradient at a position corresponding to a position different from the leading and trailing ends of the recording material is E2, E2 has a polarity identical to the charge polarity of the toner and satisfies the following relationship:

$$|E1|>|E2|.$$

4. An apparatus according to claim 3, wherein said position different from the leading and trailing ends of the recording material is a position between the recording material and a subsequent recording material.

5. An apparatus according to claim 1, wherein said potential control means is exposure means disposed downstream from said transfer member and upstream from said charging member in the movement direction of said image bearing member.

6. An apparatus according to claim 1, wherein said potential control means is charging means disposed downstream from said transfer member and upstream from said charging member in the movement direction of said image bearing member.

7. An apparatus according to claim 1, which further comprises a power supply for applying a voltage to said transfer member.

8. An apparatus according to claim 7, wherein said potential control means controls the voltage applied to said transfer member.

9. An apparatus according to claim 7, wherein said transfer member and said image bearing member form a transfer nip having a width W, and with respect to a movement direction of the recording material, the following relationships are satisfied:

V2−V1>V3−V4 when the toner has a negative charge polarity, and

V2−V1<V3−V4 when the toner has a positive charge polarity, wherein V1 represents a voltage applied to said transfer member when a leading end of said recording material is located upstream from an upstream end of the transfer nip by W; V2 represents a voltage applied to said transfer member when the leading end of said recording material is located downstream from the upstream end of the transfer nip by W; V3 represents a voltage applied to said transfer member when a trailing end of said recording material is located upstream from a downstream end of the transfer nip by W; and V4 represents a voltage applied to said transfer member when the trailing end of said recording material is located downstream from the downstream end of the transfer nip by W.

10. An apparatus according to claim 7, wherein said transfer member and said image bearing member form a transfer nip having a width W, and with respect to a movement direction of the recording material, the following relationships are satisfied:

$$(V2-V1)/2W>(V4-V3)/2W>E3, \text{ and}$$

$$(V2-V1)/2W>|E3|,$$

wherein V1 represents a voltage applied to said transfer member when a leading end of said recording material is located upstream from an upstream end of the transfer nip by W; V2 represents a voltage applied to said transfer member when the leading end of said recording material is located downstream from the upstream end of the transfer nip by W; V3 represents a voltage applied to said transfer member when a trailing end of said recording material is located upstream from a downstream end of the transfer nip by W; V4 represents a voltage applied to said transfer member when the trailing end of said recording material is located downstream from the downstream end of the transfer nip by W; and E3 represents a maximum of the potential gradient having a polarity opposite from the charge polarity of the toner.

11. An apparatus according to claim 1, which further comprises developing means for developing a latent image formed on said image bearing member, said developing means recovering the toner on said image bearing member.

12. An image forming apparatus, comprising:

a movable image bearing member, a charging member disposed opposed to said image bearing member, a transfer member for transferring a toner image from said image bearing member onto a recording material, a power supply for applying a voltage to said transfer member, and potential control means for changing a potential gradient on said image bearing member at a position corresponding to an end of the recording material in a direction opposite from a charge polarity of the toner with respect to a direction opposite from a movement direction of said image bearing member, wherein said transfer member and said image bearing member form a nip having a width W, and with respect to a movement direction of the recording material, the following relationships are satisfied:

V2−V1>V3−V4 when the toner has a negative charge polarity, and

V2−V1<V3−V4 when the toner has a positive charge polarity, wherein V1 represents a voltage applied to said transfer member when a leading end of said recording material is located upstream from an upstream end of the transfer nip by W; V2 represents a voltage applied to said transfer member when the leading end of said recording material is located downstream from the upstream end of the transfer nip by W; V3 represents a voltage applied to said transfer member when a trailing end of said recording material is located upstream from a downstream end of the transfer nip by W; and V4 represents a voltage applied to said transfer member when the trailing end of said recording material is located downstream from the downstream end of the transfer nip by W.

13. An image forming apparatus, comprising:

a movable image bearing member, a charging member disposed opposed to said image bearing member, a transfer member for transferring a toner image from said image bearing member onto a recording material, a power supply for applying a voltage to said transfer member, and potential control means for changing a potential gradient on said image bearing member at a position corresponding to an end of the recording material in a direction opposite from a charge polarity of the toner with respect to a direction opposite from a movement direction of said image bearing member, wherein said transfer member and said image bearing member form a transfer nip having a width W, and with respect to a movement direction of the recoding material, the following relationships are satisfied:

$$(V2-V1)/2W>(V4-V3)/2W>E3, \text{ and}$$

$$(V2-V1)/2W>|E3|,$$

wherein V1 represents a voltage applied to said transfer member when a leading end of said recording material is located upstream from an upstream end of the transfer nip by W; V2 represents a voltage applied to said transfer member when the leading end of said recording material is located downstream from the upstream end of the transfer nip by W; V3 represents a voltage applied to said transfer member when a trailing end of said recording material is located upstream from a downstream end of the transfer nip by W; V4 represents a voltage applied to said transfer member when the trailing end of said recording material is located downstream from the downstream end of the transfer nip by W; and E3 represents a maximum of the potential gradient having a polarity opposite from the charge polarity of the toner.

14. An apparatus according to claim 1, wherein said charging member is contactable with said image bearing member.

15. An apparatus according to claim 12, wherein said charging member is contactable with said image bearing member.

16. An apparatus according to claim 13, wherein said charging member is contactable with said image bearing member.

17. An apparatus according to claim 9, wherein the toner image is formed on said image bearing member by reversal development.

18. An apparatus according to claim 10, wherein the toner image is formed on said image bearing member by reversal development.

19. An apparatus according to claim 12, wherein the toner image is formed on said image bearing member by reversal development.

20. An apparatus according to claim 13, wherein the toner image is formed ons aid image bearing member by reversal developments.

* * * * *

UNITED STATES PATENT AND TRADEMARK OFFICE

CERTIFICATE OF CORRECTION

PATENT NO. : 6,915,088 B2
DATED : July 5, 2005
INVENTOR(S) : Ken Nakagawa et al.

It is certified that error appears in the above-identified patent and that said Letters Patent is hereby corrected as shown below:

Title page,
Item [57], ABSTRACT,
Line 5, “far” should read -- for --.

Column 2,
Line 58, “by-produce” should read -- by-product --.

Column 5,
Line 1, “in-the” should read -- in the --.
Line 12, “effect stably” (1st occurrence) should be deleted.
Line 50, “a” should read -- an --.

Column 8,
Line 11, “irradiate” should read -- irradiated --.

Column 12,
Line 47, “varies” should read -- varies. --.

Column 24,
Line 65, “w” should read -- W --.

Column 25,
Line 24, “a” should be deleted.

Column 32,
Line 24, “ons aid” should read -- on said --.

Signed and Sealed this

First Day of November, 2005

JON W. DUDAS
*Director of the United States Patent and Trademark Office*